US006601719B2

(12) United States Patent
Harrington

(10) Patent No.: US 6,601,719 B2
(45) Date of Patent: Aug. 5, 2003

(54) LOCKING AND LATCHING SYSTEM FOR A TELESCOPING BOOM

(75) Inventor: Daniel L. Harrington, Lexington, KY (US)

(73) Assignees: Link-Belt Construction Equipment Co., L.P., LLLP, Lexington, KY (US); Sumitomo Construction Machinery, Lexington, KY (US)

( * ) Notice: Subject to any disclaimer, the term of this patent is extended or adjusted under 35 U.S.C. 154(b) by 0 days.

(21) Appl. No.: 09/961,033

(22) Filed: Sep. 21, 2001

(65) Prior Publication Data

US 2003/0057172 A1 Mar. 27, 2003

(51) Int. Cl.[7] ..... B66C 23/693
(52) U.S. Cl. ..... 212/292; 212/270; 212/349
(58) Field of Search ..... 212/292, 348, 212/349, 350, 270; 52/118

(56) References Cited

U.S. PATENT DOCUMENTS

| | | | | |
|---|---|---|---|---|
| 4,036,372 | A | | 7/1977 | Rao et al. |
| 4,258,853 | A | | 3/1981 | Gill et al. |
| 4,327,533 | A | | 5/1982 | Sterner |
| 4,433,515 | A | | 2/1984 | Mentzer et al. |
| 4,490,951 | A | | 1/1985 | Mentzer et al. |
| 4,492,311 | A | | 1/1985 | Rathe |
| 4,592,474 | A | | 6/1986 | Rathe |
| 4,635,805 | A | | 1/1987 | Mentzer |
| 4,688,689 | A | | 8/1987 | Barsuhn |
| 4,699,281 | A | | 10/1987 | Kishi |
| 5,624,046 | A | | 4/1997 | Zimmermann |
| 5,628,416 | A | | 5/1997 | Frommelt et al. |
| 6,062,404 | A | | 5/2000 | Erdmann |
| 6,086,256 | A | | 7/2000 | Paschke et al. |
| 6,098,824 | A | | 8/2000 | Krebs et al. |
| 6,108,985 | A | | 8/2000 | Paschke et al. |
| 6,109,394 | A | | 8/2000 | Messenger |
| 6,164,468 | A | | 12/2000 | Erdmann |
| 6,189,712 | B1 | * | 2/2001 | Conrad et al. ..... 212/292 |
| 6,206,213 | B1 | * | 3/2001 | Conrad ..... 212/292 |
| 6,216,895 | B1 | | 4/2001 | Erdmann et al. |
| 2002/0056693 | A1 | | 5/2002 | Stowasser et al. |

FOREIGN PATENT DOCUMENTS

| | | | |
|---|---|---|---|
| DE | 198 24 672 | * | 5/1998 |
| EP | 0476225 | | 3/1992 |

OTHER PUBLICATIONS

"Well–rounded New rounded boom styles all AT cranes to perform better and travel lighter" The Industrial Evolution, Nov.–Dec. 1999 Crane Works 65.
"Dematic Redesigns AC 100 boom," International Cranes, May 2000.
"Industrial Vehicle Technology '99" date and author unknown.
"Twin–Lock" Boom Telescoping Systems date and author unknown.

* cited by examiner

*Primary Examiner*—Thomas J. Brahan
(74) *Attorney, Agent, or Firm*—King & Schickli, PLLC

(57) ABSTRACT

A locking and latching system for use with a telescoping boom assembly in a crane or other lifting device is provided. The system may include complementary devices for latching and unlocking a selected boom section for telescoping movement relative to a next-adjacent boom section using an extension cylinder. Preferably, the devices are activated in a predetermined sequence using a single motive device. The motive device may include a single cylinder for performing both the locking and latching function. The locking and latching cylinder may be axially aligned with the extension cylinder to create a relatively compact locking and latching system that easily fits within the confines of the innermost boom section in a conventional boom assembly.

24 Claims, 11 Drawing Sheets

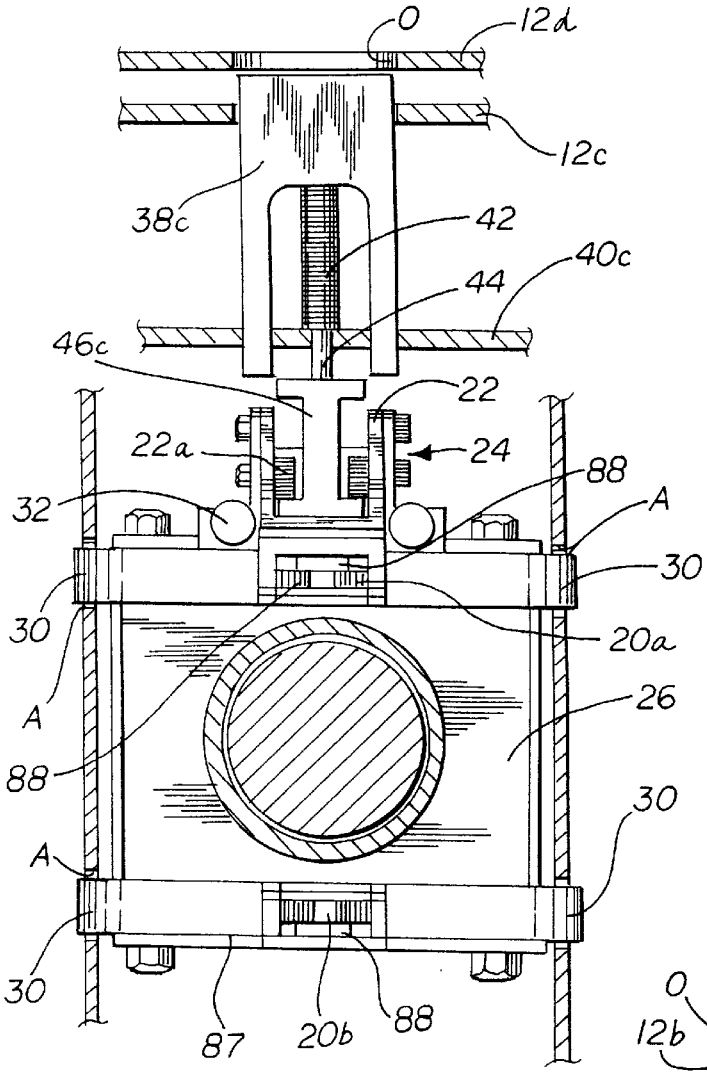
Fig. 4c
Fig. 3a
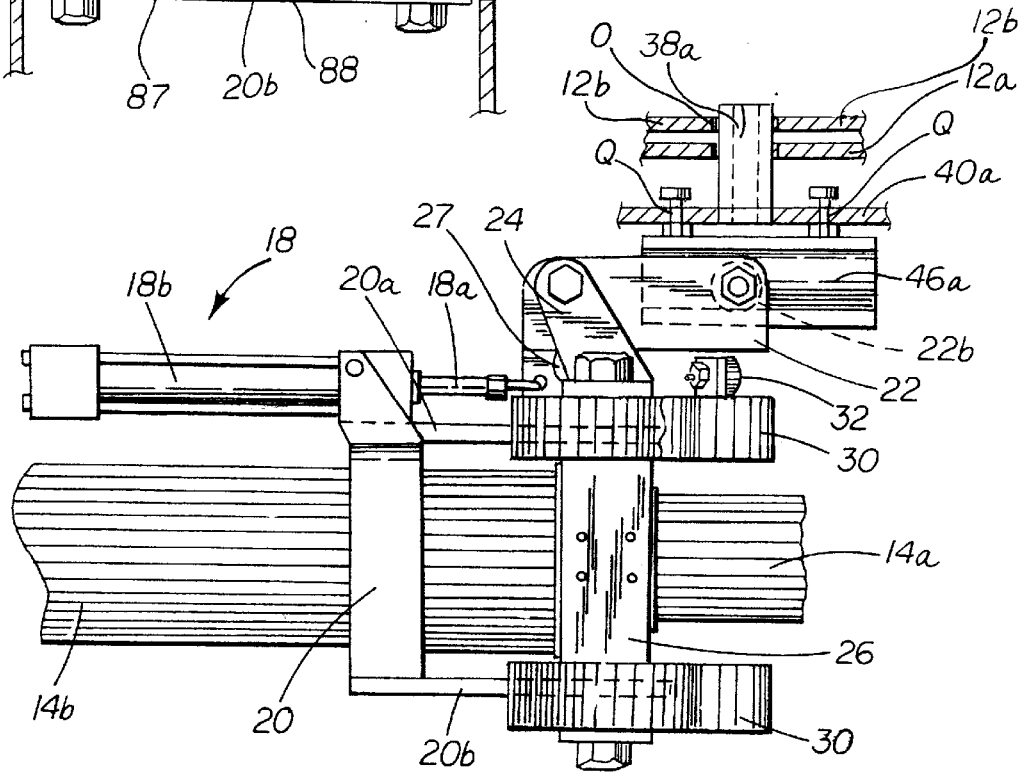

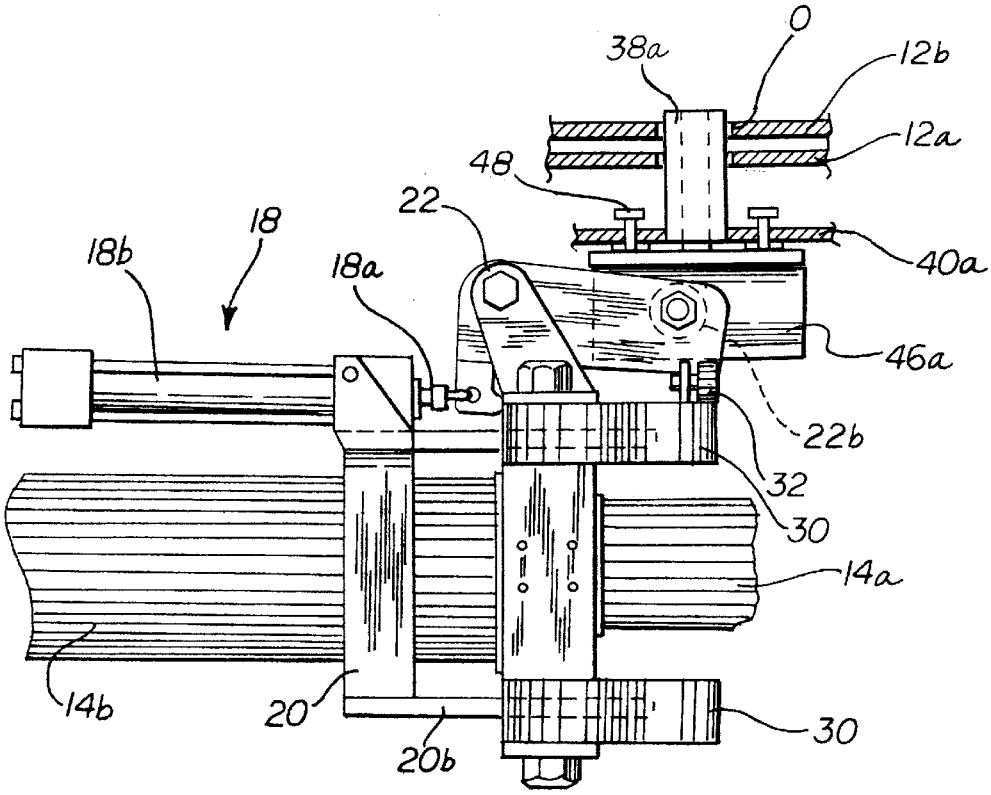
Fig. 3b
Fig. 3c
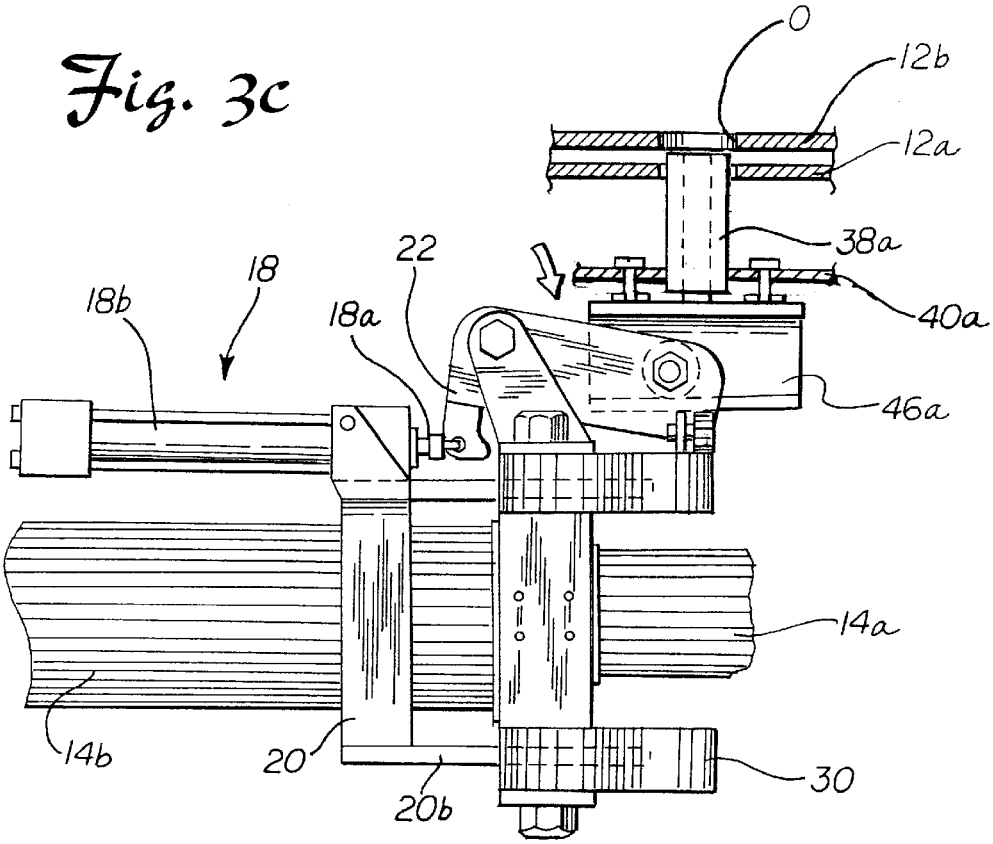

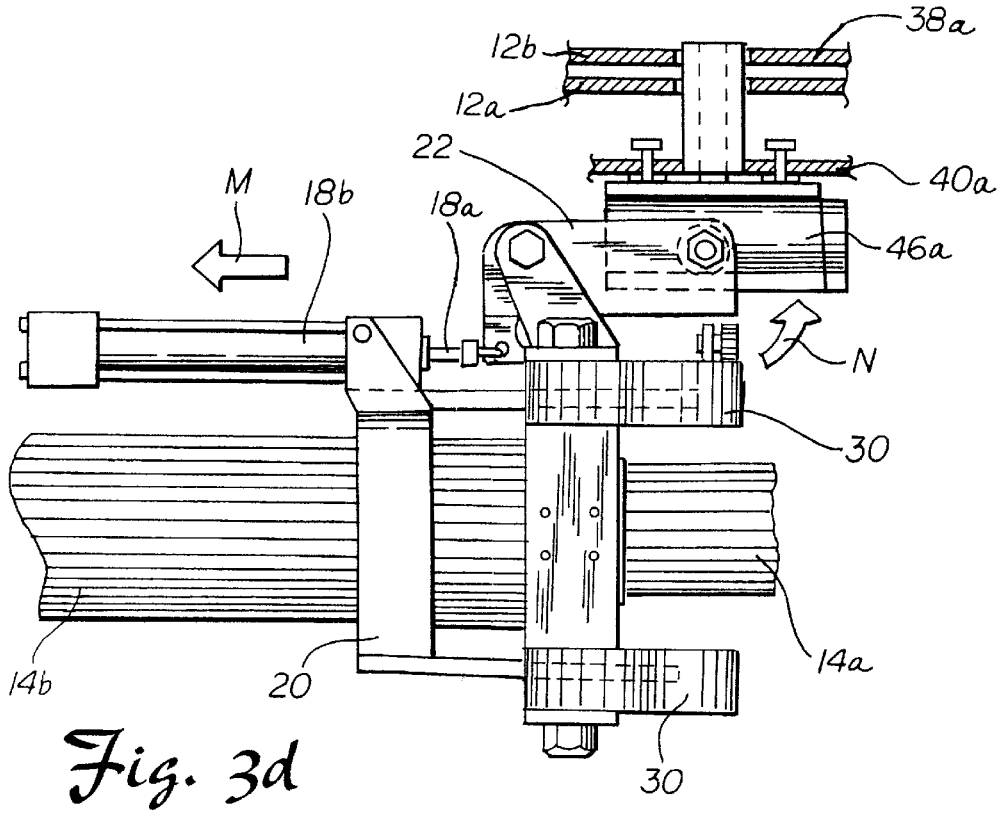
Fig. 3d
Fig. 3e
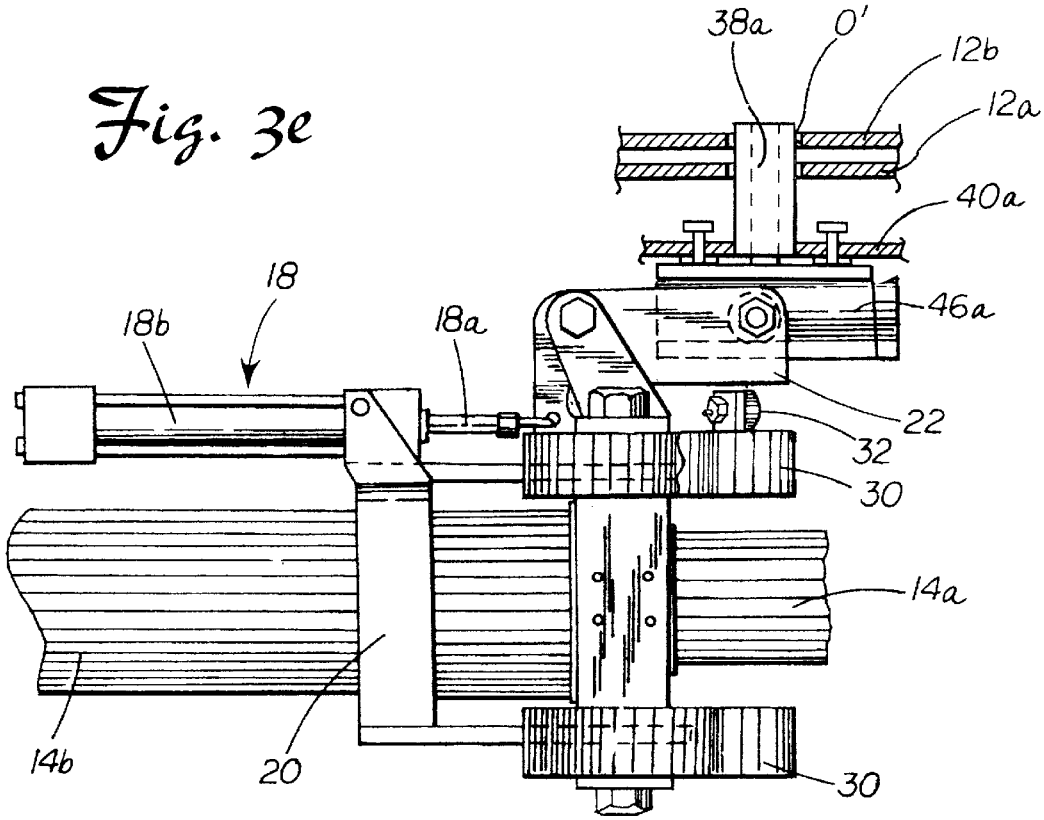

LOCKING AND LATCHING SYSTEM FOR A TELESCOPING BOOM

TECHNICAL FIELD

The present invention related generally to lifting devices, such as cranes or the like, and more particularly to a complementary locking and latching system for a telescoping boom.

BACKGROUND OF THE INVENTION

Various types of telescoping booms or boom assemblies for use in cranes or other lifting devices are known in the art. The conventional boom assembly includes a plurality of nested tubular sections, with each outer section having larger cross-sectional size than the next-adjacent inner section to permit the desired relative telescoping movement. In the typical arrangement, the proximal end of the outermost boom section is pivotally mounted on a turntable and the distal end of the innermost section carries one or more sheaves or equivalent structures for supporting the hoisting cable or the like.

Usually, to telescopingly move (extend or retract) a selected boom section relative to a next-adjacent boom section, a motive device such as a boom "extension" cylinder is employed. This extension cylinder is often positioned inside the innermost boom section, with the proximal end of the piston rod (often called the "rod end" of the cylinder) either pivotably or fixedly mounted to a stable structure, such as the endwall of the outermost boom section or an adjacent component of the crane. To couple the selected boom section to the "case" end of the extension cylinder, a latching device may be provided. Such devices often include opposed pairs of transversely movable structures that, in a latched position, project through corresponding apertures formed in the sidewalls of the boom section selected for telescoping movement. Hence, when the latching device is in the latched position and the extension cylinder is extended or retracted, the selected boom section telescopingly moves toward the corresponding extended or retracted position relative to the next-adjacent boom section.

Either after the latching operation is completed, or at substantially the same time, a locking device, such as a spring-loaded pin that is normally biased to securely hold the selected boom section in place, is retracted. Then, once the selected boom section reaches the desired position as the result of the relative telescoping movement, the operation is reversed such that the locking device is moved to the locked position and the latching device is retracted, in that order. Consequently, the boom section previously selected for telescoping movement is locked in the extended or retracted position. The latching device may then be used in combination with the extension cylinder to telescopingly move another selected boom section (with the locking device associated with that selected boom section being retracted and released as described above).

While this dual locking and latching arrangement works well for its intended purpose, efficiently and effectively moving the latching device between an unlatched and a latched position, retracting the locking device, and then reversing these operations when the selected boom section reaches the desired position is somewhat difficult in practice, especially within the confines of the boom assembly. Others in the past have proposed different types of motive devices for separately actuating the latching and locking devices, but most are exceedingly complex in design and in some instances may even be unreliable in operation (thus necessitating separate "fail-safe" devices, which may include auxiliary motive devices, including hydraulic cylinders, or even manually operated locks).

For example, some less than advantageous features required in a few past arrangements include the need for actuating the locking and latching devices using multiple, completely separate motive devices, such as hydraulic piston/cylinder combinations positioned orthogonally to each other (see, e.g., U.S. Pat. No. 5,628,416 to Frommelt et al.), or using multiple motive devices in combination with corresponding complicated hydraulic control systems (see, e.g., U.S. Pat. Nos. 4,433,515 and 4,490,951, both to Mentzer et al.). In addition to a separate latching device, a more recently proposed system requires two spring-loaded locking pins positioned in the opposing sidewalls of each telescoping boom section, with each pin being actuated by a separate hydraulic cylinder (see, e.g., U.S. Pat. No. 6,216,895 to Erdmann et al.). While these systems may be effective, the requirement of using more than one motive device to effect the locking and latching operations contributes to their complexity. A direct correlation exists between complexity of the locking or latching system and not only the expense to construct, operate, and service the boom assembly, but also the overall weight and minimum size requirements.

Accordingly, a need is identified for an improved, yet simplified, complementary locking and latching system for use. with a telescoping boom assembly. In one aspect, the locking and latching system would include locking and latching devices that are essentially independent of each other in form, but work together or complement each other in operation using a single motive device. As compared to past proposals, the resulting system would thus be somewhat less complicated in design, less expensive to manufacture and install, and easier to service. In another aspect, the invention would not necessarily be limited to the use of a single motive device, since a more efficient manner of automatically retracting or releasing a locking device immediately after moving a latching device between the latched and unlatched positions would be provided. In an even more specific aspect, the locking and latching system would be relatively compact, and thus would easily fit within the confines of a conventional boom assembly. In certain applications, the compact nature of the system would even allow for use with telescoping boom assemblies having smaller dimensions than previously thought possible, without compromising the strength and lifting capability, necessitating extensive redesign, or requiring special miniature components. In yet another aspect, the system would be designed so as to minimize the weight contribution to the overall boom assembly. In final analysis, the system in all respects would be an improvement over those in the prior art in terms of efficiency and reliability, which in turn would reduce operational costs.

SUMMARY OF THE INVENTION

In accordance with a first aspect of the invention, a system for selectively latching and unlocking a selected boom section for telescoping movement relative to a next-adjacent boom section is provided. The system is especially adapted for use in a crane or lifting device having a telescoping boom assembly including at least two boom sections and an extension device for telescopically moving the selected boom section relative to the next-adjacent boom section. The system comprises a latching device for latching the selected boom section to the extension device in a latched position, a locking device for locking the selected boom section in place relative to the next-adjacent boom section, and a single motive device. The motive device includes a locking and latching cylinder for moving the latching device to the latched position and moving the locking device to an unlocked position prior to telescopingly moving the selected boom section, and then moving the locking device to a locked position and moving the latching structure to an unlatched position when the telescoping movement is completed.

In one embodiment, the locking and latching cylinder is supported by and axially aligned with the extension device. The locking and latching cylinder is also coupled .to an engagement head forming part of the motive device for moving the latching device between a latched position and an unlatched position. The latching device may include at least two pivoting latching plates (and preferably two pairs of latching plates, with one pair positioned on each side of the extension cylinder). Each plate includes a hook-like portion for projecting through a corresponding aperture in the selected boom section and a specially contoured camming surface. The engagement head of the motive device may include a pair of opposed. projections for simultaneously engaging the camming surfaces to move the latching plates into the latched position during extension of the locking and latching cylinder and to an unlatched position during retraction of this cylinder. As a result, efficient and effective latching action is reliably achieved.

The motive device may include a pivoting bellcrank for retracting a locking pin of the locking device when the latching plates are positioned in the apertures in the selected boom section. Furthermore, the engagement head of the motive device may include a bearing structure for preventing the bellcrank from pivoting when the locking and latching cylinder is in an extended or home position. In one embodiment, the movement of the engagement head moves the bearing structure away from the bellcrank, which may then pivot to retract the locking pin and allow for the extension or retraction of the selected boom section using the extension device. Alternatively, at least one, and preferably both of the latching plates may carry a bearing structure for preventing the bellcrank from pivoting. The movement of the latching plates to the latched position thus moves the support away from the bellcrank, which may then pivot to retract the locking pin and allow for the extension or retraction of the selected boom section. The bellcrank may be U-shaped, and the locking pin is coupled to a receiver, which may have an I-shaped cross-section. The receiver thus includes opposed channels for receiving opposed cams projecting inwardly from the sidewalls of the U-shaped bellcrank. The engagement between the cams and the corresponding surfaces of the opposed channels formed in the I-shaped receiver thus serves to retract and release the locking pin as a result of the pivoting of the bellcrank.

In addition to a locking pin, the locking device may further include a compression spring for normally biasing the locking pin into a corresponding opening in the next-adjacent boom section when the selected boom section is a certain position, such as the home or extended position. The pivoting action of the bellcrank serves to overcome the biasing force of the compression spring to disengage the locking pin from the corresponding opening. The selected boom section may then be moved as desired as a result of the coupling formed with the latching plates associated with the extension device.

Preferably, the piston rod of the locking and latching cylinder is coupled to the pivoting bellcrank. Consequently, during retraction of the locking and latching cylinder, the movement of the piston rod assists in pivoting the bellcrank to move the locking pin. Specifically, when the bellcrank is pivoted from a home position, the locking pin of the locking device is fully retracted from the opening in the next-adjacent boom section, thereby permitting telescoping movement of the selected boom section. When the bellcrank is returned to the home position, the locking pin is moved to the locked position to prevent the relative telescoping movement.

In a more specific embodiment, the locking and latching cylinder is coupled to a movable support frame supported by the extension device. This support frame includes first and second projections, each having an engagement head, and the latching device includes first and second pairs of spaced latching plates. The pairs of latching plates are simultaneously moved toward a latched position by the engagement heads of the projections when the locking and latching cylinder is retracted and moved toward an unlatched position when this cylinder is extended. The first and second pairs of spaced latching plates may be positioned above and below the extension device, or in any other orientation desired.

In accordance with a second aspect of the invention, a telescoping boom assembly including at least two boom sections and an extension cylinder for telescopically moving a selected boom section relative to at least one next-adjacent boom section is provided. The boom assembly comprises a latching device associated with the extension cylinder. The latching device includes at least one latching structure for engaging the selected boom section in a latched position. A locking device is also associated with the selected boom section, with the locking device including a locking pin for locking the selected boom section in place relative to the next-adjacent boom section. The boom assembly further includes a locking and latching cylinder having a first longitudinal axis axially aligned with a second longitudinal axis of the extension cylinder. The locking and latching cylinder is capable of moving the latching structure into the latched position. and moving the locking pin to an unlocked position such that the extension cylinder may be used to telescopingly move the selected boom section between positions, and then moving the locking pin to a locked position and moving the latching structure to an unlatched position when the telescoping movement is completed.

In one embodiment, the locking and latching cylinder is supported by a movable support frame, which is in turn supported by and moves with the extension cylinder during extension and retraction. In particular, the support frame may slide along the extension cylinder as the locking and latching cylinder is extended and retracted to activate the locking and latching devices. Preferably, at least one wear pad is positioned between the support frame and an outer surface of a case of the extension cylinder to create desirable low friction contact.

The telescoping boom assembly preferably includes a plurality of boom sections, as noted above, such as at least two inner boom sections that are capable of telescoping movement relative to an outer boom section. Each of the at least two inner boom sections includes a locking pin. The locking pins form part of the locking device.

In accordance with a third aspect of the invention, a system for selectively latching and unlocking a selected boom section for telescoping movement relative to a next-adjacent boom section is provided. The system is especially adapted for use in a crane or lifting device having a telescoping boom assembly including at least two boom sections and an extension cylinder for telescopically moving the selected boom section relative to the next-adjacent boom section. The system comprises at least one pair of latching plates associated with the extension cylinder for engaging the selected boom section in a latched position, at least one locking pin for locking the selected boom section in place relative to the next-adjacent boom section, and a motive device including a locking and latching cylinder. The locking and latching cylinder is coupled to a support frame. The support frame includes at least one engagement structure for engaging and moving each of the latching structures to a latched position and a pivoting retraction structure for moving the locking pin from a locked position when the locking and latching cylinder is actuated.

In one embodiment, the engagement structure includes at least one projection extending from the support frame in an axial direction. The projection includes an engagement head having opposed structures, each for engaging and moving one of the pair of latching plates to the latched position. The pivoting retraction structure includes a bellcrank that pivots to move the locking pin to an unlocked position. One of the projection or the pair of latching plates carries a bearing structure for preventing the bellcrank from pivoting until the latching plates are in the latched position.

In accordance with a fourth aspect of the invention, a method of telescopingly moving a selected boom section relative to a next-adjacent boom section in a telescoping boom assembly having an extension cylinder is provided. The method comprises actuating a latching device to latch the extension cylinder to the selected boom section using a motive device including a locking and latching cylinder, actuating a locking device to unlock the selected boom section from the next-adjacent boom section using the locking and latching cylinder, and then telescopingly moving the selected boom section using the extension cylinder. The method may further comprise the steps of: (1) releasing the locking device to lock the selected boom section in place; and (2) moving the latching device from engagement with the selected boom section. Preferably, the locking device is moved to the locked position before the latching plates are moved into the unlatched position.

BRIEF DESCRIPTION OF THE DRAWINGS

The accompanying drawings incorporated in and forming a part of the specification illustrate several aspects of the present invention and, together with the description, serve to explain the principles of the disclosed embodiments of the invention.

In the drawings:

FIG. 3*a* is a partially cutaway, partially cross-sectional view of one embodiment of the locking and latching system of the present invention, with the locking and latching cylinder in the home position such that the latching plates are in the home or unlatched position and the locking pin is in the locked position;

FIG. 3*b* is a similar view as that of FIG. 3*a,* but again showing the progressive movement of the components of the locking and latching system;

FIG. 3*c* is yet another progressive side view similar to FIGS. 3*a* and 3*b,* showing the locking and latching cylinder fully actuated such that latching plates are in the latched position, the locking pin is fully retracted and the selected boom section is ready for extension or retraction;

FIGS. 3*d* and 3*e* are progressive side views similar to FIGS. 3*a*–3*c,* but showing the reversing of the locking and latching operation once telescoping movement is completed;

FIGS. 4*a*–4*c* are partially cutaway, partially cross-sectional end views showing the progressive operation of one embodiment of the locking and latching system with a different telescoping boom section from the one shown in FIGS. 2*a*–2*c* and 3*a*–3*c;*

DETAILED DESCRIPTION OF THE INVENTION

Figure 1:
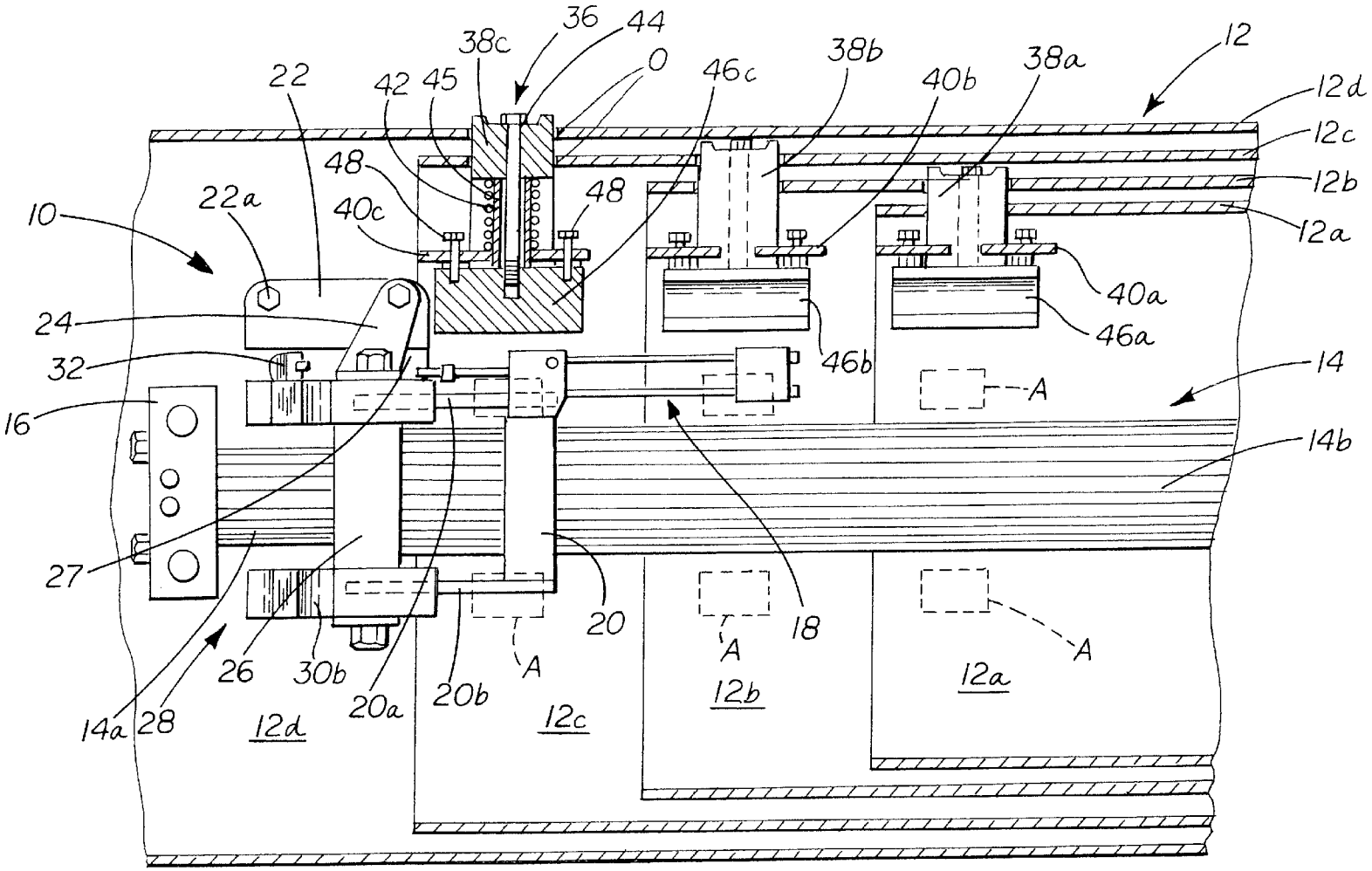
FIG. 1 is a partially cutaway, partially cross-sectional side view of a telescoping boom assembly including a locking and latching system constructed in accordance with the principles of one embodiment of the present invention.

Reference is now made to FIG. 1, which is a partially cross-sectional, partially cutaway side elevational view of a locking and latching system 10 for use with a telescoping boom assembly 12. In the embodiment illustrated, the boom assembly 12 includes four matching boom sections 12*a*–12*d,* although it should be appreciated that more or fewer sections may be provided as necessary or desired for a particular application. The distal end of the innermost boom section 12*a* (known as the "tip" section) having the smallest cross-sectional size typically carries a head end structure (not shown), which usually includes a frame for supporting one or more sheaves (not shown) or other rotatably mounted structures that engage a hoisting cable (not shown) extending from a winch on the base of the crane or lifting device.

Normally, the proximal end of the outermost boom section 12*d* is pivotably mounted to the base of the crane (not shown), such as on a rotating turntable. Thus, in addition to telescoping, the boom assembly 12 may simultaneously pivot and rotate to allow for any load being lifted by the hoisting cable to be raised or lowered to a certain height or moved to a particular location. As is known in the art, the motive force for effecting telescoping movement may be supplied by a boom extension cylinder 14 positioned inside of the innermost boom section 12*a*. Preferably, the piston rod 14*a* of the cylinder 14 includes a mounting structure or block 16 positioned near the pivot point and attached to the side or end walls of the outermost boom section 12*d* (or the block 16 may be fixed to another stable structure, and may even be constructed to allow the extension cylinder to pivot relative to the horizontal plane). The cylinder body of the extension cylinder 14, or "case" 14*b* as it is often called, normally extends into the opening defined by the innermost boom section 12*a*, which is tubular. This is preferable to the converse arrangement, since the case 14*b* is lighter than the piston rod 14*a* when the cylinder 14 is extended. A roller or wheel (not shown) may be provided on the distal portion of the case 14*b*. This wheel not only provides support for the case 14*b*, but also makes desirable rolling contact with the corresponding inside surface of the boom section 12*a* as the boom extension cylinder 14 is extended and retracted. The extension cylinder 14 is preferably hydraulically operated, and may be coupled via lines (not shown) positioned in the boom assembly 12 to a source of hydraulic fluid under pressure (not shown). The hydraulic fluid source is normally carried on the base of the crane or lifting device. However, depending on the type of boom assembly and the particular application, the use of a pneumatic cylinder may also be possible or desirable, in which case a corresponding source of a pressurized gas, such as air, is provided.

Now, with simultaneous reference to FIG. 1, as well as the progressive action views of FIGS. 1*a*–1*c*, 2*a*–2*b*, and 3*a*–3*e*, one possible embodiment of the locking and latching system 10 is described in detail. Still referring to FIG. 1, the system 10 includes a motive device, which is shown as including a single locking and latching cylinder 18. Preferably, the locking and latching cylinder 18 is mounted such that the longitudinal axis of the piston rod 18*a* is aligned with the longitudinal axis of the piston rod 14*a* of the extension cylinder 14. The locking and latching cylinder 18 may also be coupled to the same source of pressurized fluid as the extension cylinder 14, or a separate auxiliary source (not shown) may be provided. As will be further appreciated upon reviewing the description that follows, this preferred orientation of the locking and latching cylinder 18 is the primary reason that the system 10 may be compact and easily fit within the confines of a telescoping boom assembly 12 formed of tubular sections, including where the innermost boom section, such as section 12*a*, has a relatively narrow opening.

The case 18*b* of the locking and latching cylinder 18 is mounted to and supported by a stable support structure within the boom assembly 12. In the illustrated embodiment, the stable support structure is a substantially square support frame 20, which also forms part of the motive device. This frame 20 is concentric with and supported by the case 14*b* of the boom extension cylinder 14 so as to be capable of moving to and fro a certain distance (as defined by the stroke of the piston rod 18*a* of the locking and latching cylinder 18). The frame 20 also includes two projecting portions 20*a*, 20*b*, each of which is axially aligned with the piston rod 14*a* of the extension cylinder 14. These portions 20*a*, 20*b* are shown as being positioned in different horizontal planes, with one positioned above and one positioned below the boom extension cylinder 14. Each projecting portion 20*a*, 20*b* preferably includes a pair of outwardly directed opposed structures at the proximal end, which thus create a T-shaped or cross-shaped engagement head, the function of which is outlined in detail in the portion of the description that follows.

Turning back to the locking and latching cylinder 18, the proximal end of the piston rod 18*a* is coupled directly to a bellcrank 22, which also forms part of the motive device. The bellcrank 22 may be U-shaped and includes a pair of inwardly directed engagement structures, such as cams 22*a*, 22*b* at one end. The bellcrank 22 is pivotally mounted to a stationary support yoke 24 at the opposite end, and is thus capable of pivoting movement. This stationary yoke 24 is in turn supported by a stable support structure, such as a mounting block 26, carried on the case 14*b* of the extension cylinder 14. The bellcrank 22 also includes a hook-like depending portion 27 to which the end of the piston rod 18*a* of the locking and latching cylinder 18 may be attached.

The system 10 further includes a latching device 28. In one embodiment, the latching device 28 includes at least one, and preferably two pair of identical latching plates 30, with one pair positioned above and one pair positioned below the extension cylinder 14. The latching plates 30 are supported by a stable support structure on the case 14*b* of the extension cylinder 14, such as the same mounting block 26 that supports the yoke 24, and are mounted so as to be capable of pivoting or rotating movement relative to the mounting block 26. Each latching plate 30 includes an inner camming surface 30*a* that is specially contoured for engaging the outwardly directed structures on the projecting portion 20*a*, 20*b* of the frame 20. Each plate 30 also includes an outwardly directed, hook-like portion having an engagement surface 30*b*. This hook-like portion is sized and shaped to pass through a corresponding aperture A in a selected boom section 12*a*–12*c* when the plate 30 is moved to a latched position, such that a portion of the engagement surface 30*b* is near or in direct contact with the adjacent sidewall of the selected boom section 12*a*–12*c*.

In the illustrated embodiment, at least one, and preferably both of the plates 30 positioned adjacent to the bellcrank 22 (which are shown as the upper plates) also include a structure for assisting in preventing the bellcrank 22 from pivoting. This structure is shown as a bearing 32 fastened to and supported by an upstanding mounting plate 34 projecting from the upper surface of the adjacent plate 30, which thus prevents the bellcrank 22 from pivoting when the latching plates 30 are in an unlatched or home position, as depicted in FIGS. 1 and 1*a*.

A locking device 36 also forms part of the system 10. In the illustrated embodiment, which includes multiple telescoping boom sections 12*a*–12*d*, the locking device 36 includes a plurality of locking pins 38*a*–38*c*, one of which is associated with each of the inner boom sections 12*a*–12*c* (but not the outermost boom section 12*d*, which is not capable of telescoping movement). Each pin 38*a*–38*c* is adapted to register in an opening O formed in a next-adjacent boom section (such as boom section 12*d*), in at least the home and extended positions (see, e.g., FIG. 5). In the illustrated embodiment, the pins 38*a*–38*c* are shown as being generally U-shaped, but inverted, with each including a pair of spaced legs 39*a*, 39*b* projecting from a head portion (see FIGS. 4*a*–4*c*). These legs 39*a*, 39*b* are located in a pair of openings P (see FIG. 4*a*) formed in a shelf-like support structure 40*a*–40*c* positioned in and supported by each corresponding boom sections 12*a*–12*c*. As described in further detail below, the legs 39*a*, 39*b* pass through these openings P when the pin 38*a*–38*c* is retracted.

A biasing element, such as a helical compression spring 42*a*–42*c* preferably having ground or flattened ends, is provided between the upper surface of each shelf-like structure 40*a*–40*c* and the corresponding pin 38*a*–38*c,* such as in the space between the legs 39*a,* 39*b*. Each spring 42*a*–42*c* thus keeps the corresponding pin 38*a*–38*c* normally biased in a locked or home position such that it projects through the opening O in the next-adjacent boom section, such as section 12*d* in the case of locking pin 38*c*. As a result, the corresponding boom section 12*c* is prevented from telescopingly moving when the pin 38*c* is in the locked position.

A connector, such as a bolt 44 projecting through each pin 38*a*–38*c,* is also provided. The distal end of the bolt 44 is coupled to a pin puller 46*a*–46*c* associated with each locking pin 38*a*–38*c*. A tubular bushing 45 passing through the shelf-like structure 40*a*–40*c* may also be provided between the connector 44 and each adjacent compression spring 42. Each pin puller 46*a*–46*c* is positioned adjacent to the corresponding shelf-like structure 40*a*–40*c* and is shown as having an I-shape in cross section (see FIGS. 4*a*–4*c*). At least one, and preferably a pair of height-adjustable fasteners 48 also project through openings Q (see, e.g., FIG. 3*a*) in the shelf-like structure 40*a*–40*c* and are fastened to the front and rear ends of the respective pin puller 46*a*–46*c*. These fasteners 48 include oversized heads that are positioned above the openings Q, and thus define the maximum possible distance that the pin puller 46*a*–46*c* may travel during retraction of the corresponding locking pin 38*a*–38*c*. As should be appreciated from viewing FIG. 1, the oversized heads of the fasteners 48 are normally positioned well above the surface of the shelf-like structure 40*a*–40*c* when the corresponding pin 38*a*–38*c* is in the home or locked position.

Figure 1B:
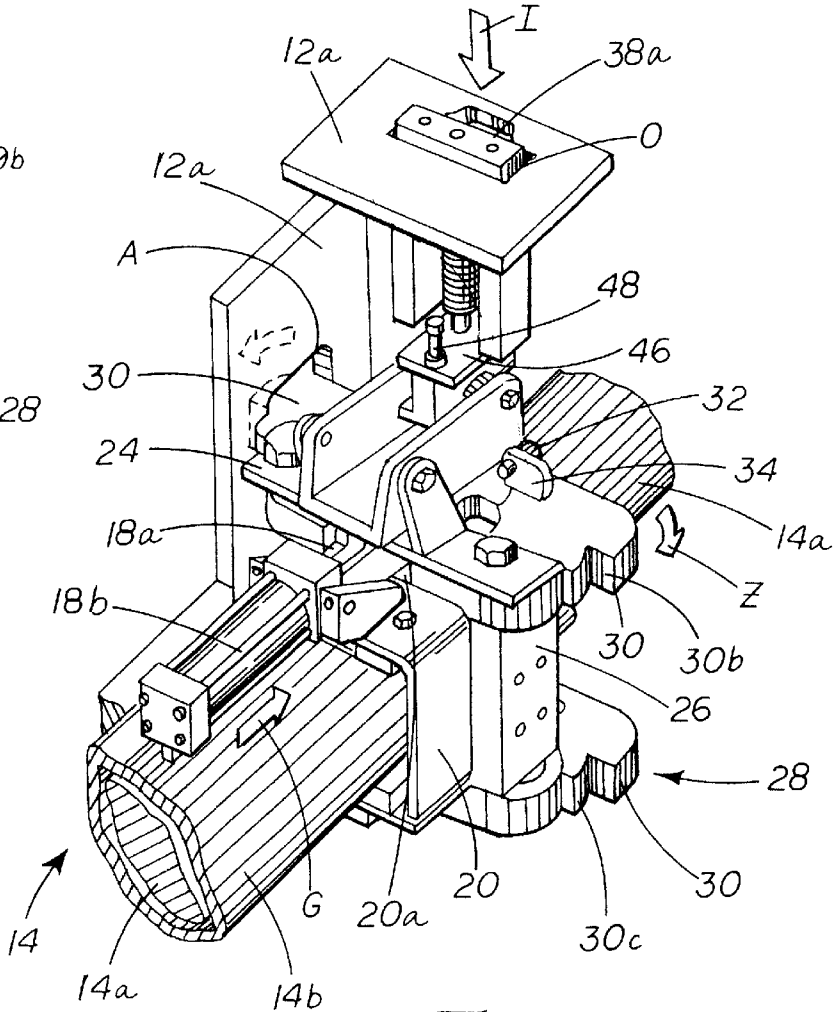
FIG. 1*b* is a second partially cutaway perspective view similar to FIG. 1*a,* but showing the progressive movement of the components of the locking and latching system as the motive device is actuated.
Figure 1A:
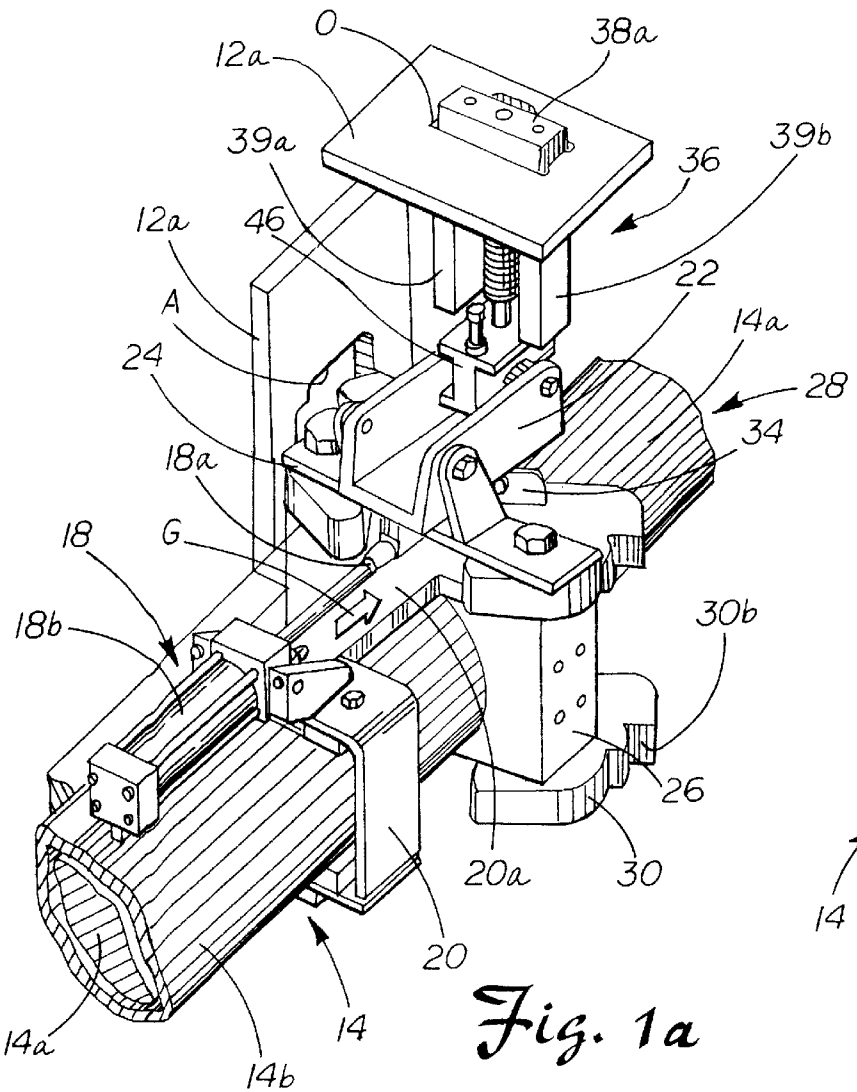
FIG. 1*a* is a partially cutaway perspective view showing the motive device forming a part of the locking and latching system in a home or nominal position.
Figure 1C:
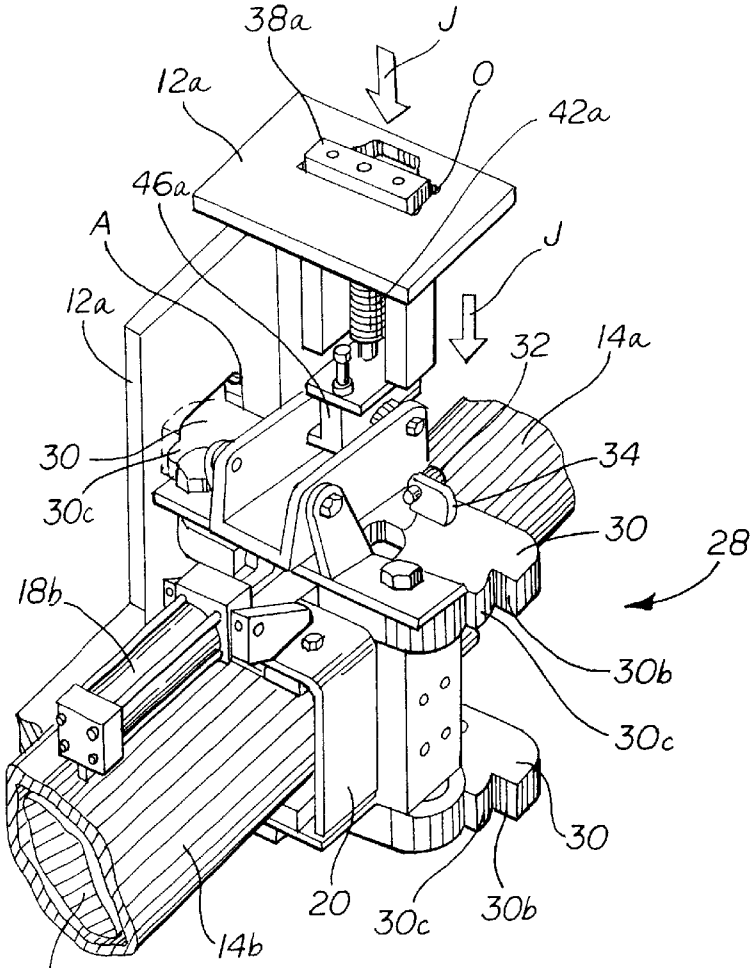
FIG. 1*c* is yet another partially cutaway perspective view similar to FIG. 1*a,* with the latching plates forming a part of the latching device in the latched position and the locking pin forming a part of the locking device in the retracted position, such that the selected boom section is ready for telescoping movement.

With specific reference now to the progressive action views of FIGS. 1*a*–1*c* (perspective), 2*a*–2*b* (partial top), and 3*a*–3*c* (side), the use of the locking and latching system 10 to release the selected boom section 12*a* for movement is described in detail. The crane operator using controls located within the cab (not shown) moves the case 14*b* of the extension cylinder 14 a certain distance from the home or nominal position such that the latching plates 30 are aligned with the corresponding apertures A formed in the sidewalls of a selected boom section, such as boom section 12*a* in this exemplary case. The distance the case 14*b* of the extension cylinder 14 must travel to reach a position where the latching plates 30 are properly aligned for insertion in the corresponding apertures A of each boom section 12*a*–12*c* may of course be predetermined and stored in an onboard computer, along with the travel distance required to align the corresponding retracted locking pin 38*a*–38*b* with each opening O in the next-adjacent boom section 12*b*–12*d,* such as when the selected boom section 12*a*–12*c* is telescopingly moved to the extended position.

The corresponding distance that the case 14*b* of the extension cylinder 14 actually moves may be measured using any well-known means, including by using rollers that contact the case 14*b* and rotate as it moves, or by attaching a cable or wire rope to it and using a potentiometer to detect the revolutions of a corresponding spool, reel, or the like. Alternatively, a more expensive and complicated position detection system, such as one using a light source and photodetectors positioned along the inside of the boom sections, may be employed (see, e.g., U.S. Pat. No. 5,628,416, the disclosure of which is incorporated herein by reference for, among other things, a boom locking and latching system requiring a photoelectric sensing system). The particular means used is not critical, as long as an accurate measurement of the distance traveled by the case 14*b* is obtained and provided to the computer so that its position relative to the selected or next-adjacent boom section 12*a*–12*d* can be determined.

In any case, based on this measurement, the computer may then determine when the case 14*b* is in the proper position, such that the latching plates 30 are aligned for insertion in the corresponding apertures A in a selected boom section (in this case, section 12*a*). The computer may then provide an indication to the operator that the proper position has been reached, such as by sounding an alarm or activating an indicator lamp on the control panel in the cab. Alternatively, or in addition to an indicator lamp or alarm, a first display such as an LCD may provide the numerical distance actually traveled by the case 14*b* from the home position adjacent to a second display indicating the distance that must be traveled to properly position the retracted latching plates 30 of the latching device 28 for insertion in the apertures A of each inner boom section 12*a*–12*c* present. Yet another possibility is to provide some form of graphical display, such as on a screen or monitor in the control panel or elsewhere in the cab. A similar indication may be provided to the operator when the selected boom section 12*a*–12*c* reaches the extended or retracted position, such that the corresponding locking pin 38*a*–38*c* is in position for being moved or inserted into the opening O in the next-adjacent boom section 12*b*–12*d*. As should be appreciated, all or any portion of these processes may also be automated, such that the operator simply selects a boom section 12*a*–12*c* for telescoping movement and activates the extension cylinder 14, with the computer controlling the operation from there to move the extension cylinder 14 to the desired position, retract the locking and latching cylinder 18 to activate the latching and locking devices 28, 36 (preferably in that order, as described further below), reactivate the extension cylinder 14 to extend or retract the latched and unlocked boom section 12*a*–12*c,* and then extend the locking and latching cylinder 18 when the telescoping movement is completed to lock the selected boom section 12*a*–12*c* in place and return the latching plates to the unlatched position.

Figure 2A:
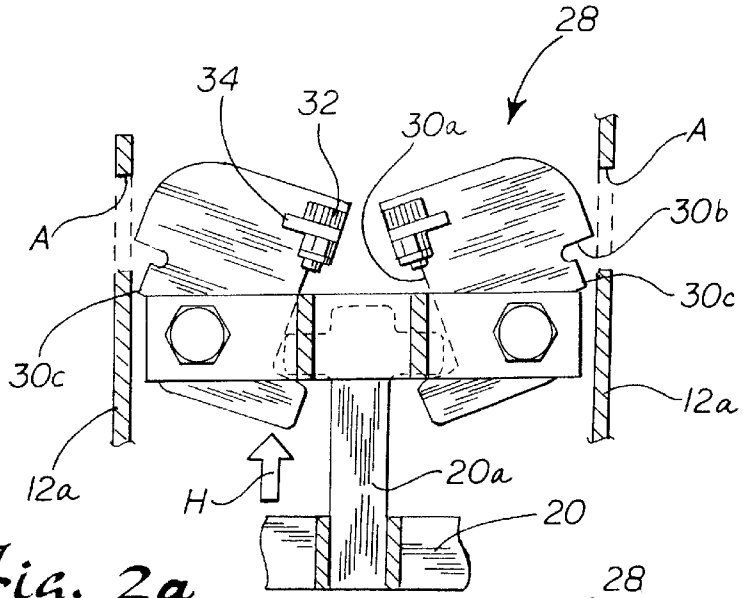
FIG. 2*a* is a partially cross-sectional, partially cutaway top view showing the latching plates in the home or unlatched position.
Figure 2B:
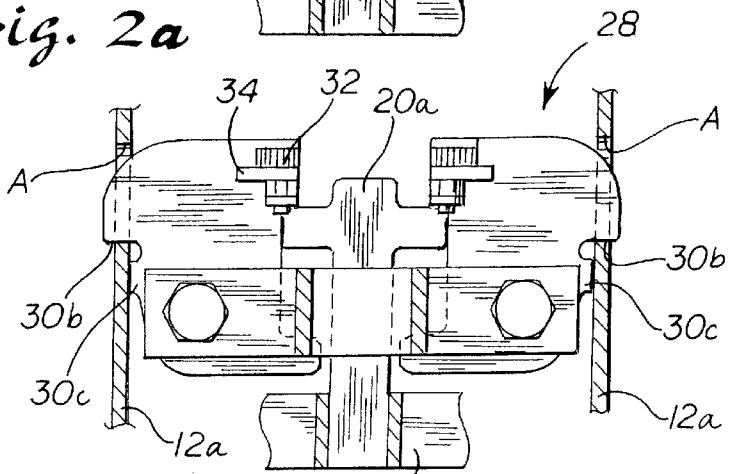
FIG. 2*b* is a similar view showing the latching plates in the latched position.
Figure 5:
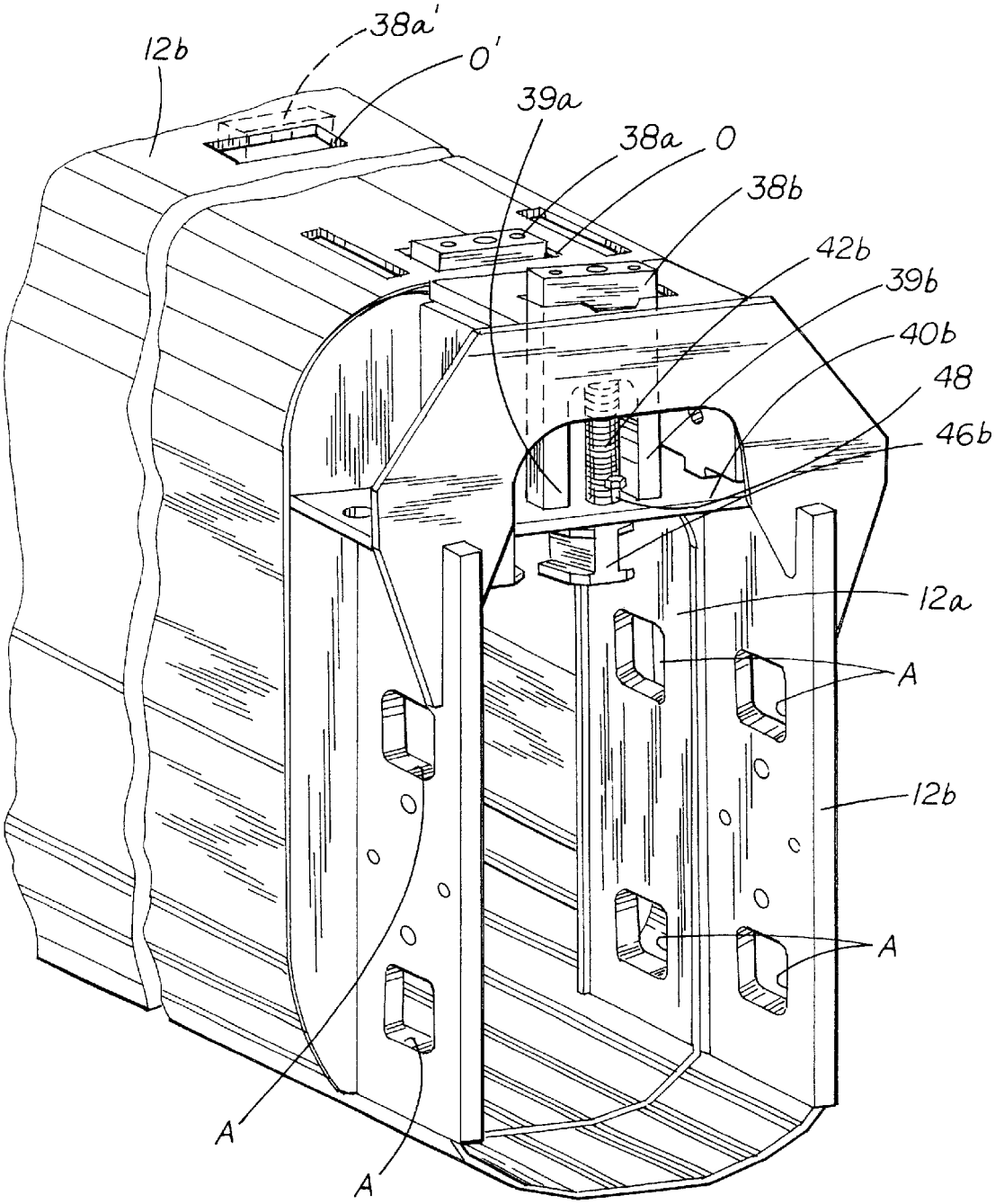
FIG. 5 is a cutaway perspective view showing two nested, telescoping boom sections, including part of the locking device on the outer boom section and the spaced pairs of apertures formed in the sidewalls for receiving the outwardly directed portions of the latching plates in the latched position.

Taking the case where the boom section 12*a* selected for telescoping movement is initially in the home or retracted position, the case 14*b* of the extension cylinder 14 is moved to a position such that the latching plates 30 are aligned with the apertures A (see FIG. 5 for a depiction of the apertures A in boom section 12*a*). It should be appreciated that, in this position, the cams 22*a,* 22*b* projecting inwardly from the U-shaped bellcrank 22 are located in the corresponding opposed channels formed in the sides of the I-shaped pin puller 46*a,* preferably just above or in actual engagement with the adjacent surfaces of the lower flanges thereof. At that time, the locking and latching cylinder 18, which in the illustrated embodiment is normally extended in the nominal or home position, is activated to move the case 18*b* towards the base of the crane or lifting device (note action arrow G in FIG. 1*a*). Since the case 18*b* of the locking and latching cylinder 18 is coupled to the non-stationary support frame 20, it moves in the same direction such that the opposed extensions on the projecting portions 20*a,* 20*b* simultaneously engage the inner camming surfaces 30*a* of each latching plate 30. This camming action moves or pivots the latching plates 30 from a home or unlatched position, as shown in FIG. 2*a* (which show only the upper plates 30 carrying the bearings 32), to a position at which-the hook-like portion of each projects through the corresponding aperture A in each side of the selected boom section 12*a,* as shown in FIG. 2*b* (again, upper plates 30 only; note also action arrow Z in FIG. 1*b*). As should be appreciated from this depiction, the engagement surface 30*b* of each plate 30 in the latched position is thus adjacent to and preferably nearly in contact with an inner surface of each corresponding aperture A, ready for the extension or retraction of the selected boom section 12*a*.

When the frame 20 is in this position, it should be appreciated that the latching plates 30 are substantially prevented from retracting by the outwardly directed, opposed portions forming the engagement head on each projecting portion 20*a*, 20*b*. This means that as long as the locking and latching cylinder 18 is activated (retracted), the plates 30 are physically prevented from moving to the unlatched position. This feature advantageously provides an enhanced level of security against an accidental retracting of the latching plates 30 without the need for auxiliary motive devices, pins, plates, or the separate controls commonly found in prior art proposals for boom locking and latching systems.

As shown in both FIGS. 2*a* and 2*b*, each latching plate 30 may also include an outwardly directed stop 30*c*. Each stop 30*c* is designed to abut with the inside surface of the sidewall of the selected boom section, such as section 12*a*, when the plates 30 are in the latched position. In the case of an outer boom section (such as section 12*c*) spaced farther away from the latching plates 30 than an inner section (such as section 12*a*, see FIG. 2*b*), inwardly projecting structures may be provided to create an abutment surface for these stops 30*c*, if desired.

With continued reference to FIGS. 1*a*–1*c* and 2*a* and 2*b*, as well as to the side views of FIGS. 3*a*–3*c*, the near-simultaneous but subsequent operation of the locking device 36 is described. As the latching plates 30 move to the latched position, the bearings 32 adjacent to the pivoting bellcrank 22 are moved away from the home position. The frictional force between pin 38*a* and opening O in the next-adjacent boom section is reduced by extending the extension cylinder case 14*b* away from its fixed (rod) end and to transfer load from pin 38*a* to latching plates 30. At a point where the bearings 32 are no longer positioned adjacent to or in contact with the bellcrank 22 (see FIG. 1*b*), it pivots about the pivot point established by the connection with the yoke 24. This motion is primarily the result of the force generated by the movement of the piston rod 18*a* during retraction of the locking and latching cylinder 18, which as noted above is coupled directly to the bellcrank 22 via the hook-like projection 27. As the bellcrank 22 pivots, the inwardly projecting cams 22*a*, 22*b* engage the adjacent surfaces of the lower flanges of the pin puller 46*a*. The locking pin 38*a* then moves downwardly as a result of the connection established by bolt 44 and out of the opening O (see action arrows I and J in FIGS. 1*b* and 1*c*, respectively). Consequently, the spring 42*a* is compressed against the shelf-like structure 40*a* (see FIG. 3*b*). The retracted or unlocked position of the locking pin 38*a* is maintained as long as the piston rod 18*a* of the locking and latching cylinder 18 is held in the actuated (retracted) position, since the bellcrank 22 is prevented from pivoting back to the home position by the extended piston rod 18*a*.

Once the locking pin 38*a* is retracted, the extension cylinder 14, which of course is now coupled to the boom section 12*a* by the latching plates 30 in the latched position, may be further extended or retracted to effect the desired telescoping movement. In the case of extension, the direct contact between the engagement surfaces 30*b* of the latching plates 30 and the sidewalls of the selected boom section 12*a* serves to transmit the motive force. Indeed, it should be appreciated that the latching plates 30 support the full weight of the selected boom section 12*a* when unlocked (and in the case of an outer section 12*b* or 12*c*, the weight of any previously extended sections as well), both during extension or retraction. As should be further appreciated, this weight creates a rotational force on latching plates 30 in the opposite direction of action arrow Z (FIG. 1*b*). This rotational force is balanced and counteracted by the projections 20*a*, 20*b* (FIG. 2*b*). The frictional force between projections 20*a*, 20*b* and the camming surfaces 30*a* prevent the movement of the frame 20 in the opposite direction of action arrow H in FIG. 2*a*. Thus, as long as there is load on the latching plates 30, they may not be withdrawn out of apertures A. Advantageously, this prevents the latching plates 30 from inadvertently moving to the unlatched positions until the corresponding locking pin 38*a*–38*c* is returned to the locked position and the load is removed from the latching plates 30.

To relock and unlatch the selected boom section 12*a* once the extended position is reached, the operation previously described is essentially reversed. Generally referring to FIGS. 3*d* and 3*e*, once the boom section 12*a* reaches a position where the locking pin 38*a* is aligned with an opening O' formed at the distal end of the next-adjacent boom section 12*b* (see FIG. 5 also), the locking and latching cylinder 18 is activated or extended. This activation causes the engagement head of the projecting portions 20*a*, 20*b* of the support frame 20 to move along the inner camming surfaces 30*a* on the latching plates 30, but initially no camming action results due to the amount of frictional contact between projections 20*a*, 20*b* and the inner camming surfaces 30*a* (see FIG. 2*b*). However, as the piston rod 18*a* moves to the extended position (note action arrow M), the bellcrank 22 pivots back to the home position almost immediately (note action arrow N), which releases the locking pin 38*a* into the opening O'. Of course, this ensures that the locking pin 38*a* is returned to the home or locked position before the latching plates 30 are retracted. Note, however, that the position of the bellcrank 22 in the longitudinal direction does not change, since it is supported by the case 14*b* of the extension cylinder 14. The case 14*b* of the extension cylinder 14 is retracted slightly to transfer load from the latching plates 30 to the locking pin 38*a*. This reduces the frictional force between the projections 20*a*, 20*b* and the camming surfaces 30*a* allowing the support frame 20 to slide axially along the case of the extension cylinder 14.

With specific reference to FIG. 3*e*, the continued activation (extension) of the locking and latching cylinder 18 then causes the outwardly directed structures forming the engagement heads of the projecting portions 20*a*–20*b* to engage an inwardly directed portion of the inner camming surface 30*a* on each plate 30. Since the selected boom section 12*a* is now locked and the weight of the now-extended section 12*a* is fully assumed by the locking pin 38*a*, this engagement causes the latching plates 30 to pivot from the latched position (FIG. 2*b*) to the unlatched or home position (FIG. 2*a*) (note that a slight adjustment of the position of the extension cylinder 14 may be necessary to release the full weight of the boom section 12*a* from the latching plates 30 prior to pivoting). Advantageously, moving the locking pin 38*a* to the locked position prior to unlatching the plates 30 provides an extra level of protection against the accidental release of the selected boom section 12*a*–12*c*. Also, once the plates 30 are in the home or unlatched positions (as shown in. FIG. 2*b*), the bearings 32 are positioned to prevent the bellcrank 22 from pivoting (as shown in FIG. 3*e*), which thus fully prevents it from retracting or unlocking the adjacent pin 38*a* as long as the plates 30 are in the unlatched or retracted position. Hence, the latching and locking devices 28, 36 are complementary, with the operation of one serving to either permit or prevent the operation of the other.

Figure 4B:
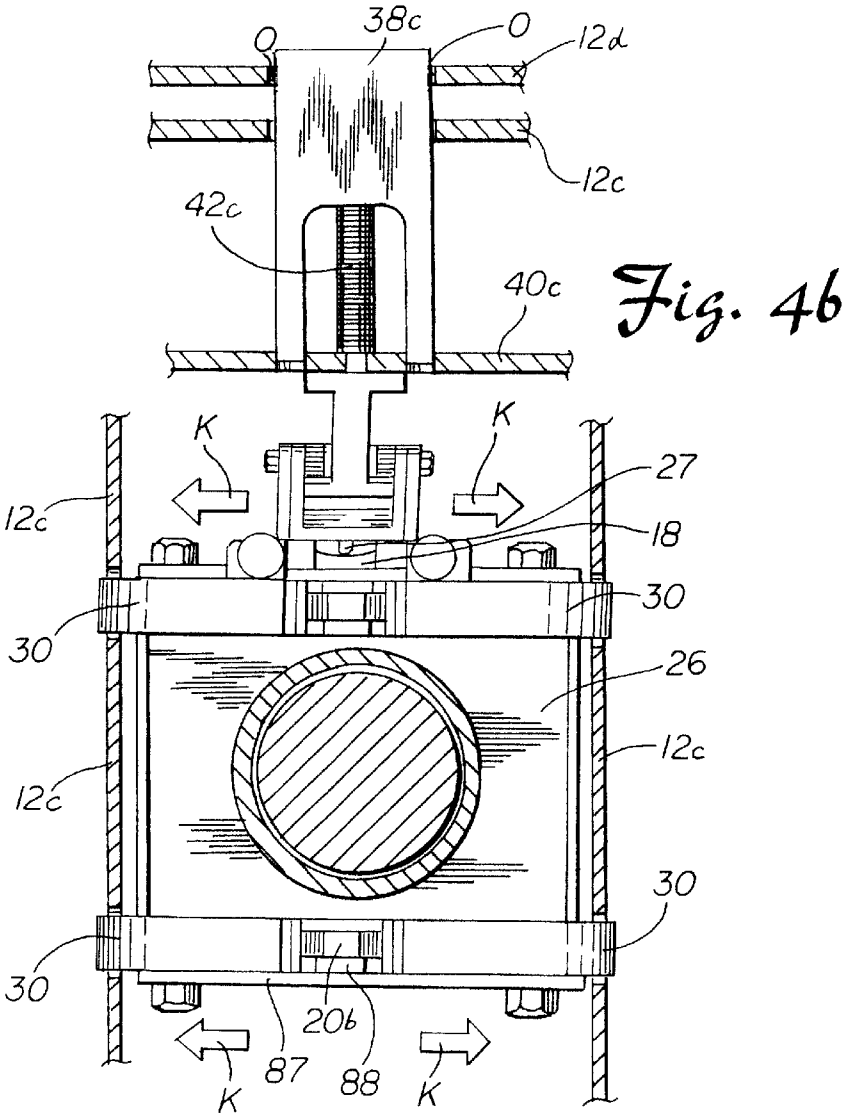
Figure 4A:
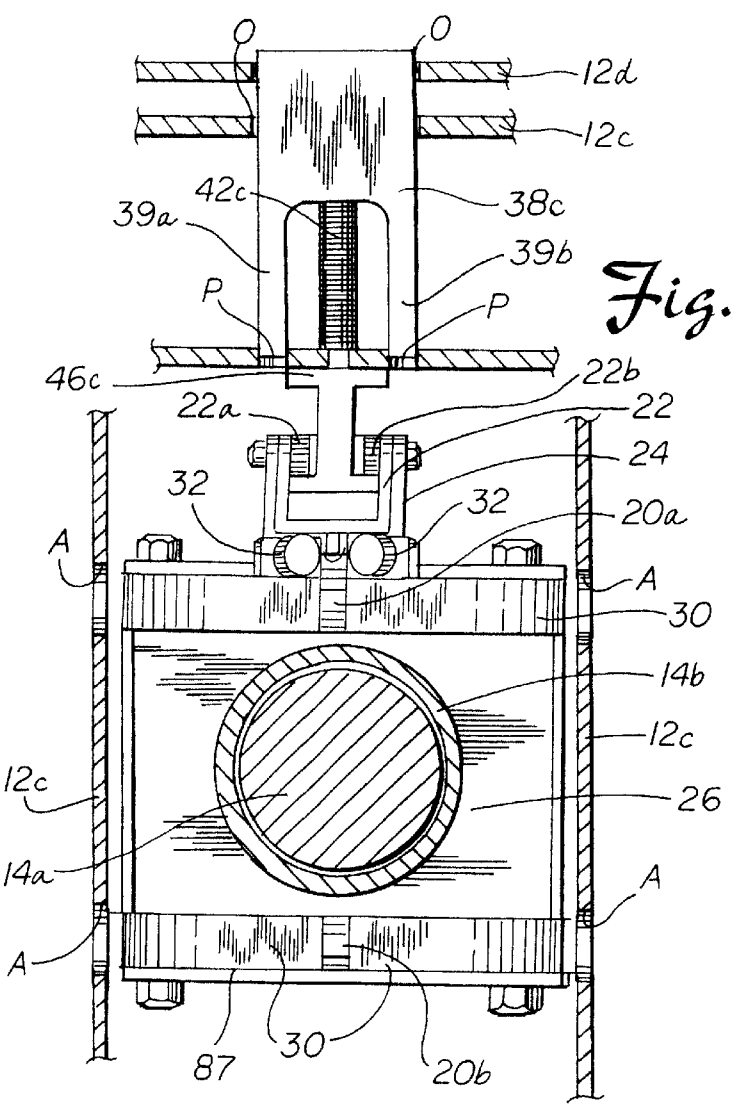

The operation of the locking and latching system 10 in which boom section 12*c* is selected for movement, such as retraction from an extended position (which presumes that any inner boom sections, such as sections 12*a* and 12*b,* have previously been extended) is shown from a different perspective in FIGS. 4*a*–4*c*. In FIG. 4*a,* the locking pin 38*c* is in the locked position, such that the head end thereof projects through and registers with the aligned openings O in both the selected boom section 12*c* and the next adjacent (in this case, outermost) boom section 12*d*. The case 14*b* of the extension cylinder 14 is moved to the position where the latching plates 30 align with the apertures A in the sidewalls of boom section 12*c* and the cams 22*a,* 22*b* projecting inwardly from the sidewalls of the bellcrank 22 are positioned in the opposed channels of the pin puller 46*c*.

The locking and latching cylinder 18 is then actuated (retracted). Consequently, the engagement head of each projecting portion. 20*a,* 20*b* engages the camming surfaces 30*a* of the latching plates 30, which in turn move into apertures A (see FIG. 4*b* and note opposed action arrows K). This moves bearings 32 away from the bellcrank 22, which then begins to pivot (note action arrow L). such that the cams 22*a,* 22*b* engage the pin puller 46*c*. The frictional force between pin 38*c* and opening O in the next adjacent boom section is reduced by extending the extension cylinder case 14*b* away from its fixed (rod) end and to transfer load from pin 38*c* to latching plates 30. Now the bellcrank 22 is free to pull the locking pin 38*c* away from the opening in the next-adjacent/outermost boom section 12*d,* toward the unlocked position. The movement of the bellcrank 22 continues as a result of the actuation of the locking and latching cylinder 18 until it is fully retracted and the spring 42*c* is compressed such that locking pin 38*c* is moved out of the opening O at the distal end of the next-adjacent, outermost boom section 12*d*. The extension cylinder 14 is then actuated to telescopingly move or retract the selected boom section 12*c* into boom section 12*d,* with any previously extended inner boom sections, such as sections 12*a,* 12*b,* being simultaneously moved toward the base of the crane or lifting device. When the selected section 12*c* reaches the retracted position, as determined by comparing the known position of the opening O in the proximal end of the next-adjacent boom section 12*d* with the distance traveled by the extension cylinder 14, the locking and latching operations are reversed as previously described, such that the locking pin 38*c* moves to the locked position and then the latching plates 30 are moved to the retracted or unlatched positions. Advantageously, this requires only activating or extending the locking and latching cylinder 18.

As should now be appreciated, in the illustrated embodiment, both the operation of latching and unlocking a selected boom section 12*a*–12*c* for extension or retraction is completed using a single motive device. Preferably, the single motive device uses only one locking and latching cylinder 18 to provide the locking and latching action. This advantageously reduces the contribution of the locking and latching system 10 to the overall weight of the boom assembly 12, the required maintenance, and the overall complexity. Also, since the single locking and latching cylinder 18 of the motive device is preferably axially aligned with the extension cylinder 14, a more compact or low-profile locking and latching system 10 results.

For purposes of illustrating the operation of the system 10, the locking and latching operation is described and illustrated as being performed on the boom section 12*a* during extension, which is the innermost section just inside of the next-adjacent boom section 12*b,* or on outer boom section 12*c* during retraction. In the case where three or more nonextended boom sections 12*a*–12*d* are present and extension is desired, it is desirable to start the telescoping operation by latching and then unlocking the innermost boom section 12*a,* working inside out from that point. In other words, the innermost section 12*a* is first latched, unlocked, extended, locked and unlatched, and then the extension cylinder 14 is retracted to a position such that the latching plates 30 are aligned for insertion in the corresponding apertures A In the next-adjacent outer boom section 12*b*. The latching plates 30 are then moved to the latched position, the locking pin 38*b* is pulled, the case 14*b* of the extension cylinder 14 is moved a predetermined distance, and the locking pin 38*b* is moved in a selected opening O in the next-adjacent boom section 12*c*. This operation is repeated as necessary until the boom assembly 12 is extended in the desired fashion.

Reference to FIG. 5 is made to illustrate one possible construction of the telescoping boom assembly 12, with only two nested boom sections 12*a* and 12*b* shown for purposes of simplicity. The locking pin 38*b* of the next-adjacent boom section 12*b* is illustrated, including the dual legs 39*a,* 39*b,* as is the shelf-like projection 40*b,* the compression spring 42*b,* and the pin puller 46*b* having an I-shaped cross-section. The spaced pairs of corresponding apertures A for receiving the outwardly directed portions of the latching plates 30 in the latched position are shown formed in the sidewall of each inner boom section, which in this case includes only sections 12*a* and 12*b* (note that apertures A would not be provided in boom section 12*b* if it were the outermost boom section in the boom assembly 12, since it would be non-telescoping).

It is noted that in the embodiment of FIG. 5, each boom section 12*a* –12*b* preferably has a rounder lower profile, which is a preferable shape in terms of strength per unit of weight. Regardless of the shape of the boom sections 12*a*–12*c,* tribologically enhanced wear pads (not shown) are preferably interposed between the front and rear portions of adjacent sections to provide reduced friction contact. Although not shown in FIG. 5, any outer boom sections present, such as sections 12*c* and 12*d* preferably match sections 12*a* and 12*b* in shape.

FIG. 5 also illustrates the locking pin 38*a* of the innermost boom section 12*a* in the locked position, such that it projects through the opening O in the next adjacent boom section 12*b*. Also shown in phantom is the locking pin 38*a″* associated with the innermost boom section 12*a* projecting through the opening O' at the distal end of the next-adjacent boom section 12*b,* as would occur when the selected boom section 12*a* is latched, unlocked, extended, relocked, and unlatched, preferably in that order. A similar, but reversed, operation is performed when the inner boom section 12*a* is retracted to the position shown in FIG. 5. As should be appreciated, the same operation is completed on boom section 12*b* when it is selected for telescoping movement relative to section 12*c,* or section 12*c* relative to section 12*d,* or any combination of selected and next-adjacent boom sections.

Figure 6:
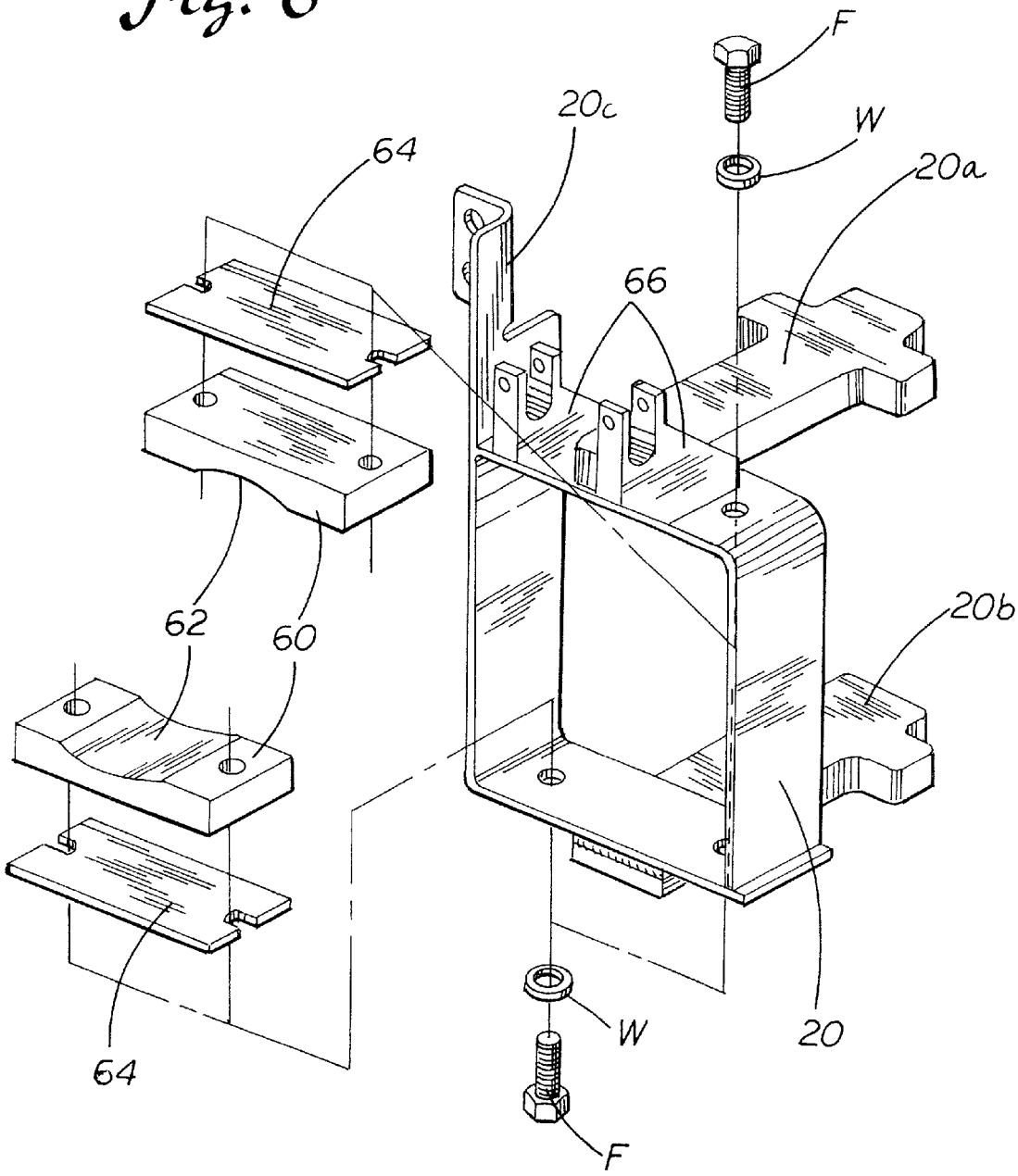
FIG. 6 is an exploded perspective view showing the support frame for the locking and latching cylinder, both of which are part of the motive device.

With reference now to FIG. 6, one possible manner of supporting the movable support frame 20 relative to the extension cylinder 14 is illustrated. Specifically, at least one, and preferably a pair of wear pads 60 are provided along the inside surfaces of opposed sides of the frame 20 (such as along the upper and lower surfaces, in the case where the frame 20 is oriented with the projections 20*a* and 20*b* extending in different horizontal planes). Each wear pad 60 includes an engagement surface 62 contoured to match the generally cylindrical outer surface of the case 14*b* of the extension cylinder 14. Shims or spacers 64 may also be provided as necessary or desired to ensure that the reduced-friction, sliding contact is evenly achieved between the wear pad 60 and the outer surface of the case 14*b*. Each assembly including the wear pad 60 and the shim or spacer 64 may be secured in place by one or more fasteners F, such as threaded screws. These fasteners F project through apertures in the frame 20 and engage corresponding apertures in the material forming the wear pad 60. Optional washers W may also be provided.

FIG. 6 also illustrates that the frame 20 may include a trunnion-style mount for receiving the locking and latching cylinder 18. This trunnion mount is shown as comprising a pair of spaced supports 66 including U-shaped slots for receiving stub shafts projecting from the sides of the case 18*b* of the cylinder 18 and aligned apertures for receiving fasteners (riot shown). Although not previously depicted, FIG. 6 also shows the frame 20 as having a third projecting portion 20*c*, which may include aligned apertures or other structures for receiving and guiding any hoses or fittings (not shown) used to supply pressurized fluid to the adjacent locking and latching cylinder 18, such as from a main or auxiliary source on the base of the crane or lifting device.

Figure 7:
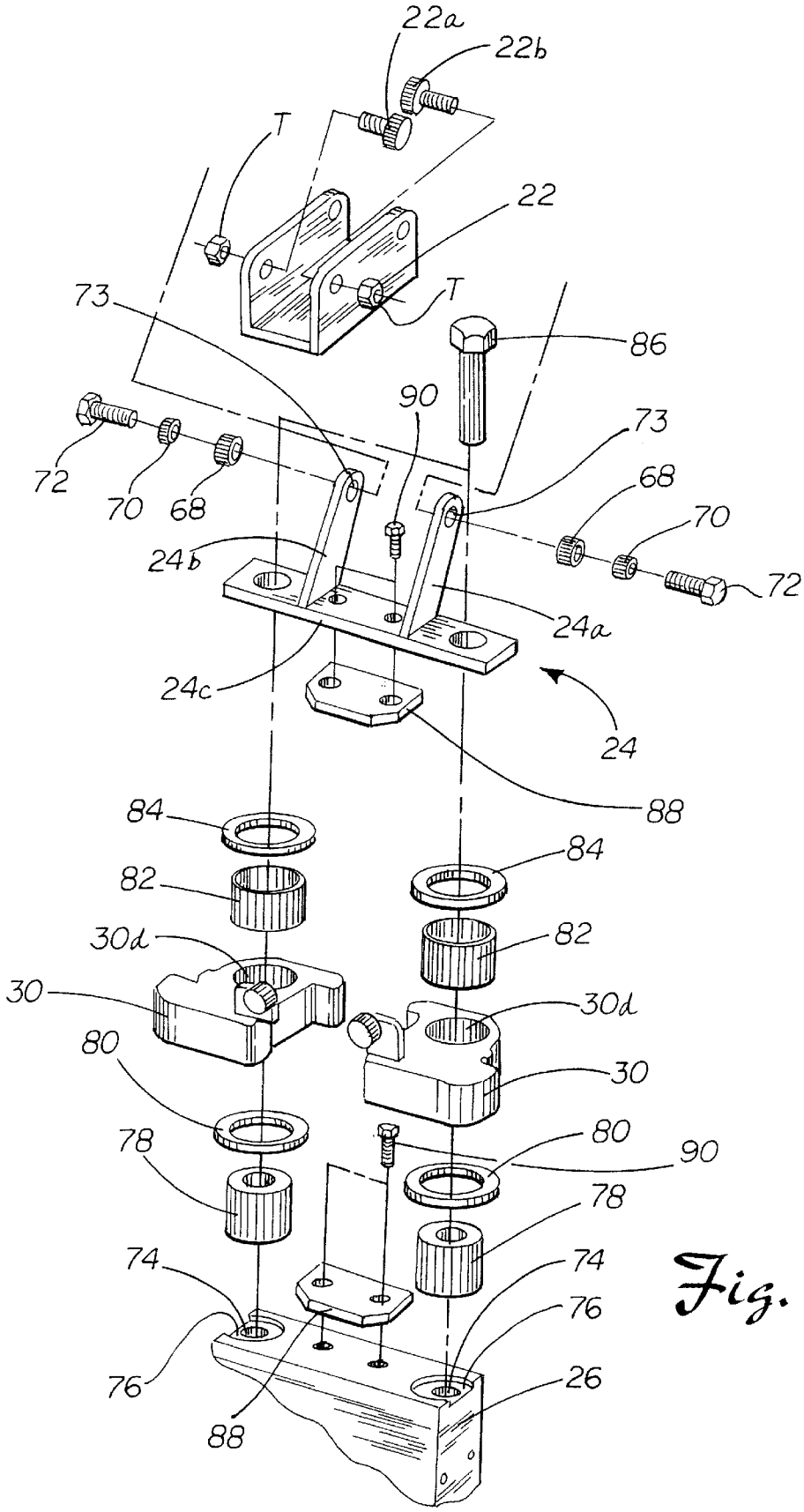
FIG. 7 is an exploded perspective view showing the mounting of the bellcrank and the manner in which the latching plates are pivotably mounted to a mounting block carried on the case of the extension cylinder.

Turning now to FIG. 7, the mounting of the bellcrank 22 and the latching plates 30 to permit pivoting movement is shown. Starting at the top of this figure, the U-shaped bellcrank 22 carries a pair of inwardly directed cams 22*a*, 22*b*. Each cam 22*a*, 22*b* includes a disc-shaped engagement head at one end and a projecting portion at the opposite end that is received in an aperture (not labeled) formed in the corresponding sidewall of the bellcrank 22. A nut T may also be provided for securing the cams 22*a*, 22*b* to the bellcrank 22.

The yoke 24 includes spaced pivot structures 24*a*, 24*b* for pivotably supporting the bellcrank 22. The pivot structures 24*a*, 24*b* are secured to a base 24*c* of the yoke 24 and include oversized apertures 73 in which a bushing 68 and a spacer 70 are inserted. A fastener, such as a capscrew 72, is then inserted into the aperture 73 in each pivot structure 24*a*, 24*b* and through the second aperture in the sidewall of the bellcrank 22. As a result of this arrangement of structures, the bellcrank 22 is capable of freely pivoting in response to the extension or retraction of the locking and latching cylinder 18.

Turning now to the bottom of FIG. 7, the mounting block 26 may be provided with spaced apertures 74 surrounded by seating recesses 76 adapted for receiving a spacer 78. A thrust bearing 80 may be provided over the spacer 78 for engaging a first surface of each latching plate 30. A bushing 82 is inserted in an aperture 30*d* formed in each latching plate 30 at a strategic location to achieve the desired range of pivoting movement, with the inner surface of the bushing 82 engaging the outer surface of the spacer 78. A second thrust bearing 84 may also be provided for engaging a second surface of each latching plate 30. The yoke 24 is positioned over the second thrust bearing 84, and a fastener, such as a capscrew 86, is inserted into each aperture in the base 24*c*, through each spacer 78, and into the mounting block 26. The result is that the yoke 24 is held securely in place against upward or side-to-side movement, while each latching plate 30 is capable of freely pivoting about the axis defined by the capscrew 86 as a result of being engaged by projections 20*a*, 20*b*.

A similar arrangement of structures may be provided for the other pair of latching plates 30, if present, the only exception being that the yoke 24 may be replaced by a simple tie plate 87 (see FIGS. 4*a*–4*c*). This substitution is possible because no structures for pivotably supporting a bellcrank 22 are required on the opposite side of the extension cylinder 14. Even with this modification, it should be appreciated that the same pivoting action may be reliably achieved as a result of the interaction between the engagement heads of the projecting portions 20*a*, 20*b* of the frame 20 and the inner camming surfaces 30a of the latching plates 30.

It is also noted in FIG. 7 that wearpads 88 are provided on the yoke 24 and the opposing surface of the mounting block 26. These pads 88 provide a low-friction wear surface for the projecting portions 20*a* of the frame 20 as it moves to and fro as a result of the actuation of the locking and latching cylinder 18. The wear pads 88 may be held in place by one or more fasteners, such as machine screws 90, extending into apertures formed in the yoke 24 and mounting block 26, respectively. A similar wear pad 88 may be provided on the tie plate 87 which serves as a substitute for the yoke 24 along the opposite side of the extension cylinder 14, as is shown in FIGS. 4*b* and 4*c*.

Figure 8A:
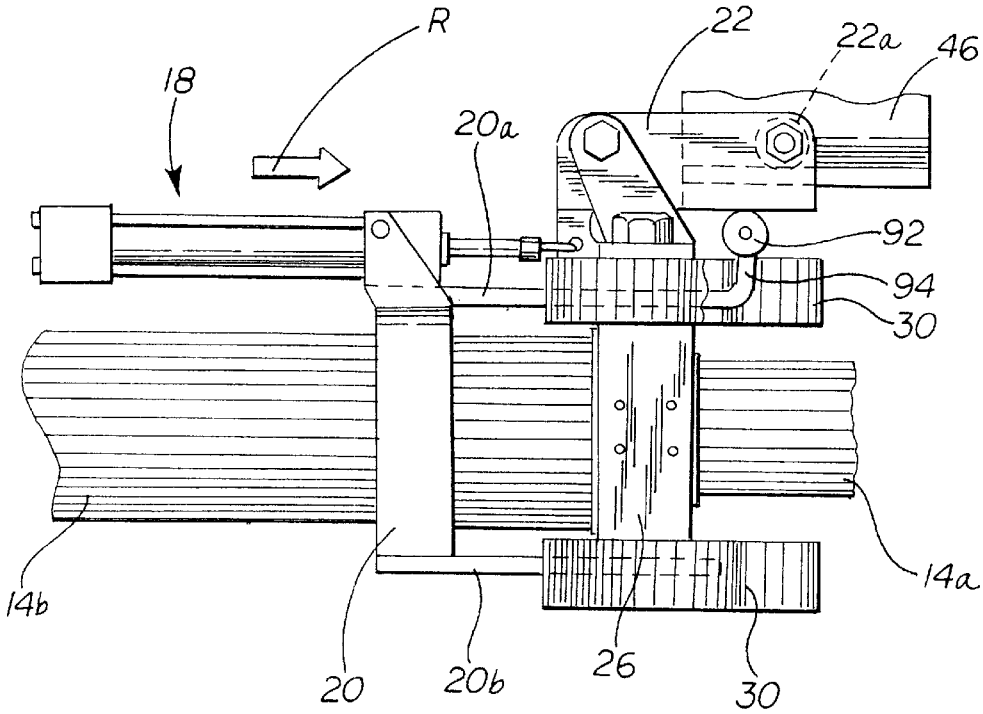
FIGS. 8*a* and 8*b* are partially cutaway side views showing the progressive operation of a second embodiment of the locking and latching system of the present invention.
Figure 8B:
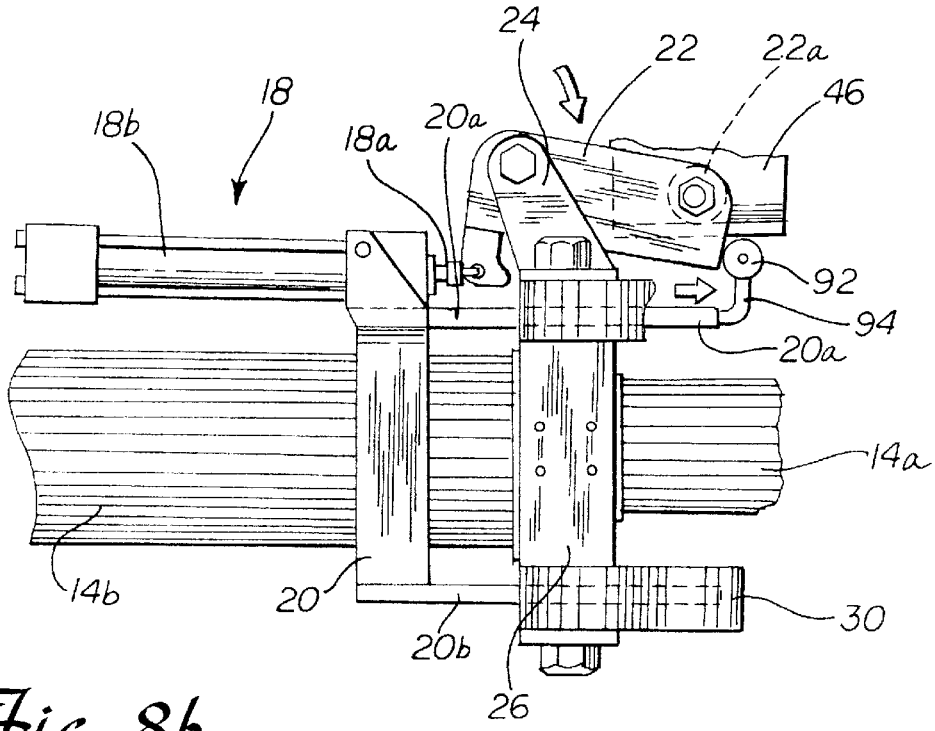

An alternate embodiment of the locking and latching system 10 is shown in FIGS. 8*a* and 8*b*. The primary difference in the alternate embodiment is that the support bearings 32 are no longer provided for preventing the bellcrank 22 from pivoting when the latching plates 30 are in a latched position. Instead, a bearing 92 (which may be stationary or capable of rotating) is positioned on and carried by a support 94 extending from the end of the projecting portion 20*a*, which is shown as being positioned above the adjacent extension cylinder 14. Hence, as the locking and latching cylinder 18 is retracted such that the frame 20 is moved towards the bellcrank 22, the bearing 92 moves in the same direction (note action arrow R). When the projecting portion 20*a* reaches a position such that each latching plate 30 is cammed to the latched position, as in the first embodiment, the bearing 92 is positioned such that the bellcrank 22 is free to pivot and unlock the corresponding locking pin (not shown) by way of the engagement between the cams 22*a*, 22*b* and the corresponding pin puller 46. As shown in FIG. 8*b*, the bearing 92 may be just adjacent to or in contact with the distal end of bellcrank 22 when the pin puller 46 is pulled. When the locking and latching cylinder 18 is then actuated (extended), such as for moving the latching plates 30 to the unlatched position and returning the locking pin (not shown) to the locked position, the bearing 92 is returned to a position adjacent to or in contact with the bellcrank 22. The bearing 92 in the home position thus prevents the bellcrank 22 from pivoting, which ensures that an adjacent locking pin 38*a*–38*c* cannot be retracted as long as the locking and latching cylinder 18 is extended and hence the latching plates 30 are in the unlatched position.

In summary, an improved locking and latching system 10 for a boom assembly 12 is disclosed. The system 10 includes complementary locking and latching devices 28, 36 that are preferably operated by a single motive device, including at least one locking and latching cylinder 18. The locking and latching cylinder 18 is preferably axially aligned with the extension cylinder 14 used to telescopingly move a selected boom section 12*a*–12*c* relative to a next-adjacent boom section 12*b*–12*d*, and thus fits well within the confines of the boom assembly 12. The latching device 26 includes at least one, and preferably two pairs of spaced latching plates 30. These plates 30 are selectively moved between an unlatched position and a latched position in engagement with the selected boom section 12*a*–12*c* by the engagement head of a projecting portion 20*a,* 20*b* of a support frame 20 coupled to and moved by the locking and latching cylinder 18. Once the latching plates 30 are in place, the locking and latching cylinder 18 also assists in pivoting a bellcrank 22 such that a pin puller 46*a*–48*c* is engaged and a corresponding locking pin 38*a*–38*c* projecting through aligned openings formed in the selected and next-adjacent boom sections 12*a*–12*d* is moved to an unlocked position. Using the extension cylinder 14, the selected boom section 12*a*–12*c* is then telescopingly moved (extended or retracted) as desired, until the corresponding locking pin 38*a*–38*c* is aligned with a corresponding opening O formed in the next-adjacent boom section (such as at a predetermined extended or retracted position). The locking and latching cylinder 18 is then actuated, such that the bellcrank 22 is first pivoted to return the corresponding locking pin 38*a*–38*c* to the locked position and then the engagement heads of the projecting portions 20*a,* 20*b* of the support frame 20 return the latching plates 30 to the unlatched position. This ensures that the selected boom section 12*a*–12*c* is locked in place before the latching plates 30 are retracted. The locking and unlatching operation is then repeated for any other boom section 12*b*–12*c* selected for telescoping movement.

The foregoing description of the invention has been presented for purposes of illustration and description. The description is not intended to be exhaustive or to limit the invention to the precise form disclosed. Obvious modifications or variations are possible in light of the above teachings. For example, the relative orientation of the components may be altered without substantially changing the overall principles of operation of the system 10. Also, a second cylinder may be used as part of the motive device, as necessary or desired, such as for assisting in moving the support frame 20 to and fro. In addition, while the bellcrank 22 is shown as being U-shaped, it could simply be a flat plate with a cam on one or both sides. Also, the receiver (pin puller 46) may be C-shaped to engage only a single cam on the bellcrank 22 (or the receiver could have opposing, spaced C-shaped channels for engaging cams projecting from a flat or U-shaped bellcrank 22). The embodiments described were chosen to provide the best illustration of the principles of the invention and its practical application to thereby enable one of ordinary skill in the art to utilize the invention in various embodiments and with various modifications as are suited to the particular use contemplated. All such modifications and variations are within the scope of the invention as determined by the appended-claims when interpreted in accordance with the breadth to which they are fairly, legally and equitably entitled.

In the claims:

1. In a crane or lifting device having a telescoping boom assembly including at least two boom sections and an extension device for telescopically moving a selected boom section relative to at least one next-adjacent boom section, a system for selectively latching and unlocking the selected boom section for relative telescoping movement, comprising:

a latching device for latching the selected boom section to the extension device in a latched position;

a locking device for locking the selected boom section in place relative to the next-adjacent boom section; and a motive device including at least one locking and latching cylinder for moving said latching device into the latched position and moving said locking device to an unlocked position to permit the extension device to telescopingly move the selected boom section, and then moving the locking device to a locked position and moving the latching structure to an unlatched position when the telescoping movement is completed, wherein said latching device includes at least two pivoting latching plates, each having a portion capable of projecting into a corresponding aperture in the selected boom section in the latched position and a camming surface;

wherein the locking and latching cylinder is supported by and axially aligned with the extension device and is coupled to an engagement structure forming part of the motive device for moving the latching device between the latched and unlatched positions, said engagement structure including a projection for engaging each camming surface to move the latching plates into the latched position during extension of the latching cylinder and to an unlatched position during retraction of the latching cylinder;

whereby efficient and effective locking and latching action is reliably achieved.

2. The locking and latching system according to claim 1, wherein the locking device includes a retractable locking pin and the motive device includes a pivoting bellcrank for retracting the locking pin when said latching plates are in the latched position.

3. The locking and latching system according to claim 2, wherein the engagement structure of the motive device includes a bearing structure for preventing the bellcrank from pivoting when the latching cylinder is in a home position, whereby the movement of the engagement structure moves the bearing structure away from the bellcrank, which may then pivot to retract the locking pin and allow for the telescoping movement of the selected boom section.

4. The locking and latching system according to claim 2, wherein at least one of said latching plates includes a bearing structure for preventing the bellcrank from pivoting, whereby the movement of the latching plates to the latched position moves the bearing structure away from the bellcrank, which may then pivot to retract the locking pin and allow for the telescoping movement of the selected boom section.

5. The system according to claim 2, wherein the bellcrank is U-shaped and the locking pin is coupled to an I-shaped receiver including opposed channels for receiving a bearing structure projecting inwardly from each sidewall of the U-shaped bellcrank, whereby the engagement between the bearing structure and corresponding surfaces of the I-shaped receiver serves to retract the locking pin when the bellcrank pivots.

6. The system according to claim 5, wherein the locking device further includes a spring for normally biasing the locking pin into the locked position in a corresponding opening in the next-adjacent boom section, whereby the pivoting action of the bellcrank serves to overcome the biasing force of the spring to disengage the locking pin from the opening.

7. The locking and latching system according to claim 6, wherein a piston rod of the locking and latching cylinder is coupled to the pivoting bellcrank, whereby retraction of the piston rod assists in pivoting the bellcrank to retract the locking pin of the locking device and extension of the piston rod assists in pivoting the bellcrank to move the locking pin to the locked position.

8. The locking and latching system according to claim 1, wherein the locking and latching cylinder is axially aligned with and coupled to a movable support frame supported by the extension device.

9. The locking and latching system according to claim 8, wherein:

the movable support frame includes first and second projections axially aligned with the extension device, each having an engagement head; and the latching device includes first and second pairs of spaced latching plates, wherein the pairs of latching plates are simultaneously moved toward a latched position by the engagement head of the each projection when the locking and latching cylinder is retracted and moved toward an unlatched position when the locking and latching cylinder is extended.

10. The locking and latching system claim 8, wherein the first and second pairs of spaced latching plates for engaging corresponding apertures in the selected boom section are provided above and below the extension device.

11. A telescoping boom assembly including at least two boom sections and an extension cylinder having a first longitudinal axis for telescopically moving a selected boom section relative to at least one next-adjacent boom section, said boom assembly comprising:

a latching device associated with the extension cylinder, said latching device including at least two pivoting latching plates for latching the selected boom section to the extension cylinder in a latched position, each said latching plate having a portion for projecting at least partially into a corresponding aperture in the selected boom section in the latched position and a camming surface;

a locking device associated with the selected boom section, said locking device including a retractable locking pin for locking the selected boom section in place relative to the next-adjacent boom section; and a locking and latching cylinder having a second longitudinal axis axially aligned with the first longitudinal axis of the extension cylinder, said locking and latching cylinder being associated with an engagement structure including a projection for engaging each camming surface for moving said latching plates into the latched position and moving said locking pin to an unlocked position to permit the extension cylinder to telescopingly move the selected boom section and moving the latching structure to an unlatched position and moving the locking pin to a locked position when the telescoping movement of the. selected boom section is completed.

12. The boom assembly according to claim 11, wherein the locking and latching cylinder is supported by a frame which is in turn supported by and moves with the extension cylinder during extension and retraction, whereby the movable support frame slides along the extension cylinder as the locking and latching cylinder is extended and retracted.

13. The boom assembly according to claim 12, wherein at least one wear pad is positioned between the support frame and an outer surface of the extension cylinder.

14. The boom assembly according to claim 11, further including at least three telescoping boom sections, including at least two inner boom sections and an outer boom section, wherein each of said at least two inner boom sections includes a retractable locking pin.

15. In a crane or lifting device having a telescoping boom assembly including at least two boom sections and an extension cylinder for telescopically moving a selected boom section relative to at least one next-adjacent boom section, a system for selectively latching and unlocking the selected boom section for relative telescoping movement, comprising:

at least one pair of latching plates associated with the extension cylinder for engaging the selected boom section in a latched position;

at least one retractable locking pin for locking the selected boom section in place relative to the next-adjacent boom section; and a motive device including a locking and latching cylinder attached to a movable support frame having an engagement structure for moving the latching plates to the latched position and a retraction structure for engaging and retracting the locking pin to permit the extension cylinder to telescopingly move the selected boom section;

wherein the engagement structure includes an engagement head having opposed projections, each capable of engaging and moving one of said pair of latching plates between the latched and unlatched positions; and the pivoting retraction structure includes a bellcrank capable of pivoting to retract the locking pin once the latching plates are in a latched position.

16. The locking and latching system according to claim 15, wherein one of the projection or the pair of latching plates carries a bearing structure for preventing the bellcrank from pivoting when the latching plates are in the unlatched position.

17. A method of telescopingly latching, unlocking, and moving a selected boom section relative to a next-adjacent boom section in a telescoping boom assembly, comprising:

actuating a latching device to latch the extension cylinder to the selected boom section using a motive device including a locking and latching cylinder for moving an engagement structure associated therewith into engagement with a camming surface on each of at least one pair of rotatably mounted latching structures forming part of the latching device such that a portion of each said structure engages the selected boom section;

actuating a locking device to unlock the selected boom section for movement relative to the next-adjacent boom section using the locking and latching cylinder; and telescopingly moving the selected boom section.

18. The method according to claim 17, further comprising the steps actuating the locking device to lock the selected boom section in place once the telescoping movement is complete; and moving the latching device from the latched position.

19. The method according to claim 18, wherein the step of moving the latching device from the latched position is not performed until the selected boom section is locked in place.

20. In a crane or lifting device having a telescoping boom assembly including at least two boom sections, an extension cylinder for telescopically moving a selected boom section relative to at least one next-adjacent boom section, and a locking device for locking the selected boom section against telescoping movement in a locked position, a latching system for coupling the extension cylinder to the selected boom section for movement therewith when the locking device is in an unlocked position, comprising:

at least one pair of pivotably mounted latching plates associated with the extension cylinder for engaging the selected boom section in a latched position; and a motive device including a latching cylinder attached to a movable support frame having an engagement structure for pivoting the latching plates to the latched position and back to an unlatched position as the latching cylinder is selectively actuated.

21. The latching system according to claim 20, wherein the engagement structure simultaneously engages inner camming surfaces on each of said latching plates to move said latching plates to the latched position and assists in holding said latching plates in place as a result of a frictional engagement force established between said engagement structure and said camming surfaces when the locking device is in the unlocked position.

22. In a crane or lifting device having a telescoping boom assembly including at least two boom sections, an extension cylinder for telescopically moving a selected boom section relative to at least one next-adjacent boom section, and a latching device for latching the selected boom section to the extension cylinder for telescoping movement, a locking system for locking the selected boom section in place or unlocking the selected boom section for telescoping movement, comprising:

a locking pin capable of movement between a locked position for preventing the selected boom section from telescopingly moving and an unlocked position for permitting telescoping movement;

a pin puller coupled to the locking pin;

a bellcrank assembly including a pivoting bellcrank supported by and moving with the extension cylinder, said bellcrank including at least one cam for engaging the pin puller in a first position and moving the pin puller to a second position to move the locking pin to the unlocked position; and a motive device including a locking cylinder for assisting in pivoting the bellcrank between the first position and the second position.

23. In a crane or lifting device having a telescoping boom assembly including at least two boom sections and an extension device for telescopically moving a selected boom section relative to at least one next-adjacent boom section, a system for selectively latching and unlocking the selected boom section for relative telescoping movement, comprising:

a latching device for latching the selected boom section to the extension device in a latched position, said latching device including at least two rotatably mounted latching structures, each having a first engagement surface capable of frictionally engaging the selected boom section in the latched position and a second engagement surface;

a locking device for locking the selected boom section in place relative to the next-adjacent boom section, including when the selected boom section is in an unlatched position; and a motive device including an engagement structure capable of frictionally engaging the second engagement surface and moving each latching structure to the latched position, said motive device also moving the locking device to an unlocked position to permit the extension device to telescopingly move the selected boom section, and then moving the locking device to a locked position and moving each latching structure to an unlatched position when the telescoping movement is completed, wherein the frictional force between the engagement structure and the second engagement surface of each latching structure once the locking device is moved from the locked position and the weight of the selected boom section is assumed by the latching structures securely holds the latching structures in the latched position.

24. The system according to claim 23, wherein the first and second engagement surfaces are substantially planar.

* * * * *

UNITED STATES PATENT AND TRADEMARK OFFICE

CERTIFICATE OF CORRECTION

PATENT NO. : 6,601,719 B2
DATED : August 5, 2003
INVENTOR(S) : Daniel L. Harrington It is certified that error appears in the above-identified patent and that said Letters Patent is hereby corrected as shown below:

Column 1,
Line 6, please replace “related” with -- relates --.
Line 16, please insert an -- a -- after “having”

Column 19,
Line 45, please delete “.” after “the”

Column 20,
Line 44, please insert -- of: -- after “steps”

Signed and Sealed this

Eighteenth Day of May, 2004

JON W. DUDAS
*Acting Director of the United States Patent and Trademark Office*